US012491414B2

(12) United States Patent
Kapheim et al.

(10) Patent No.: US 12,491,414 B2
(45) Date of Patent: Dec. 9, 2025

(54) SPORTS RACQUET AND REMOVABLE WRIST STRAP

(71) Applicant: WILSON SPORTING GOODS CO., Chicago, IL (US)

(72) Inventors: Robert T. Kapheim, Chicago, IL (US); Kevin A. Vigallon, Chicago, IL (US); Benjamin Porter, Wilson, CT (US)

(73) Assignee: Wilson Sporting Goods Co., Chicago, IL (US)

( * ) Notice: Subject to any disclaimer, the term of this patent is extended or adjusted under 35 U.S.C. 154(b) by 973 days.

(21) Appl. No.: 17/670,449

(22) Filed: Feb. 12, 2022

(65) Prior Publication Data

US 2023/0256303 A1 Aug. 17, 2023

(51) Int. Cl.
*A63B 49/08* (2015.01)
*A63B 49/035* (2015.01)
*A63B 60/16* (2015.01)

(52) U.S. Cl.
CPC ..... *A63B 49/08* (2013.01); *A63B 49/035* (2015.10); *A63B 60/16* (2015.10); *A63B 2209/00* (2013.01)

(58) Field of Classification Search
CPC ..... A63B 49/08; A63B 49/035; A63B 60/16
USPC ..... 473/549, 551
See application file for complete search history.

(56) References Cited

U.S. PATENT DOCUMENTS 160,705 A * 3/1875 Patterson ..... B65B 13/20 223/102
4,045,026 A * 8/1977 Gillespie ..... A63B 60/50 473/465
4,247,975 A 2/1981 Robinson
4,265,448 A 5/1981 Anderson, Jr.
4,273,275 A * 6/1981 Vadnais ..... A63H 1/30 224/217
4,322,077 A * 3/1982 Van't Hof ..... A63B 49/08 224/220
4,591,156 A 5/1986 Attenni
5,087,309 A * 2/1992 Melton, Jr. ..... A63B 69/38 156/198
5,324,029 A * 6/1994 Kim ..... A63B 59/80 473/573
5,797,814 A 8/1998 Janes et al.
8,550,578 B2 10/2013 Brink
(Continued)

FOREIGN PATENT DOCUMENTS

DE 20 2021 003 538 3/2022
EM 009016546 5/2022
(Continued)

*Primary Examiner* — Joseph B Baldori
(74) *Attorney, Agent, or Firm* — Terence P. O'Brien; Todd A. Rathe

(57) ABSTRACT

A sports racquet and removable wrist strap system may include a head, a handle coupled to the head, a flexible tether extending from an end of the handle, a wrist strap, and a wrist strap connector releasably connecting the wrist strap to the flexible tether. The wrist strap connector includes a collar and an insert. The collar is connected to one of the wrist strap and the flexible tether and has an interior having a side opening and a side slot extending from the side opening. The insert is connected to the other of the wrist strap and the flexible tether. The insert is insertable into the interior through the side opening while portions of the wrist strap or the flexible tether are insertable into the interior through the side slot.

19 Claims, 14 Drawing Sheets

(56) References Cited

U.S. PATENT DOCUMENTS

| | | | | |
|---|---|---|---|---|
| 8,925,174 | B2 | 1/2015 | Ciliberti et al. | |
| 9,044,687 | B2 * | 6/2015 | Walker | A63H 37/00 |
| 2002/0184739 | A1 | 12/2002 | Taubner, III et al. | |
| 2017/0252621 | A1 | 9/2017 | Ross | |

FOREIGN PATENT DOCUMENTS

| | | |
|---|---|---|
| ES | 1280406 | 10/2021 |
| GB | 160400 | 3/1921 |
| GB | 443206 | 2/1936 |
| GB | 2316620 | 3/1998 |
| WO | 2016203087 | 12/2016 |

* cited by examiner

SPORTS RACQUET AND REMOVABLE WRIST STRAP

BACKGROUND

Sports racquets are using a variety of sports including racquetball, pickle ball, tennis, padel, platform tennis, squash, badminton, table tennis and the like. Some sports racquets are equipped with wrist straps that extend about the wrist associated with the hand gripping the racquet. The wrist strap assists in maintaining control over the racquet should a player lose his or her grip of the racquet.

Figure 1:
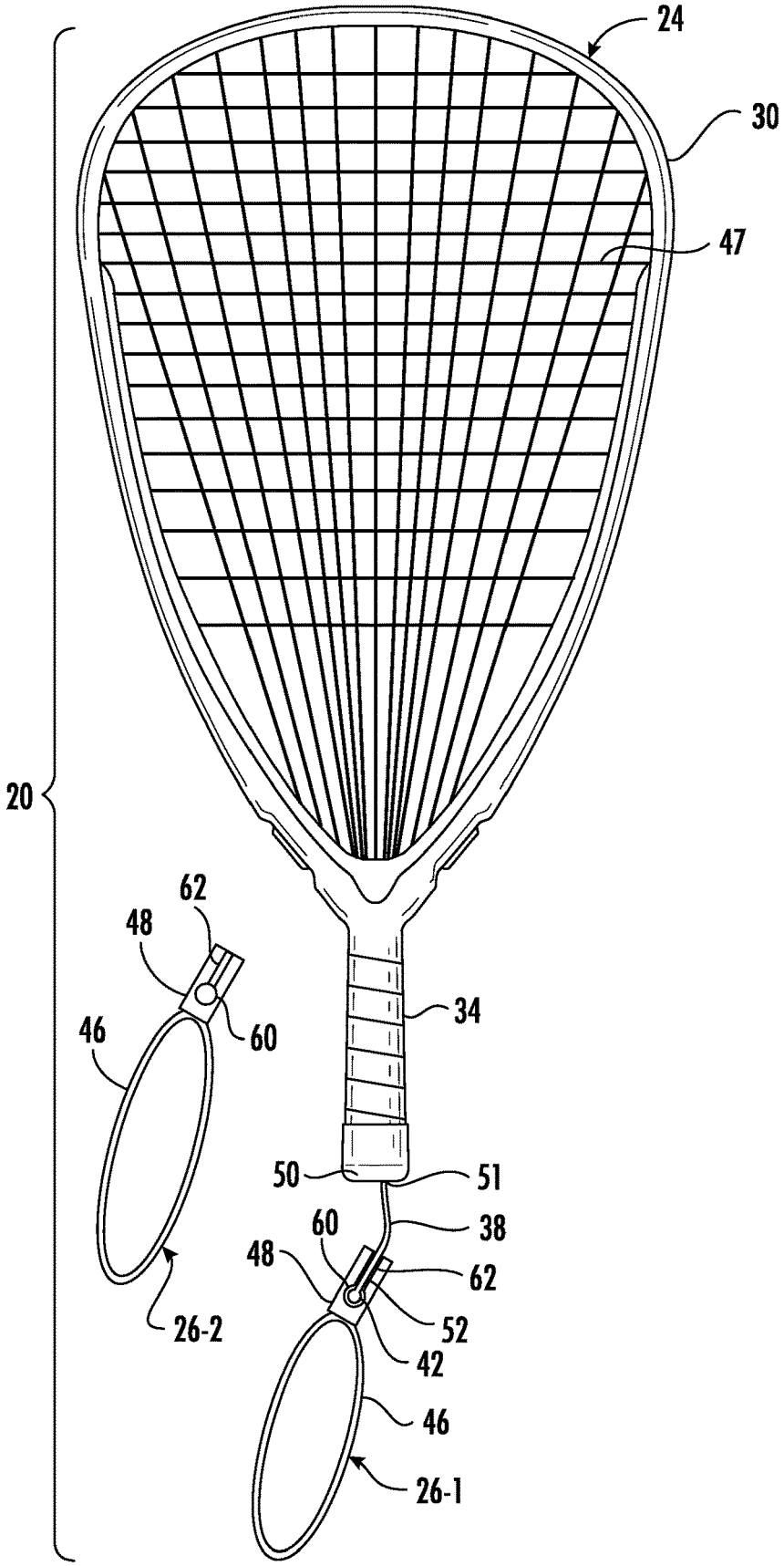
FIG. 1 is a perspective view illustrating portions of an example sports racquet and removable wrist strap assembly system.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example sports racquet and removable wrist strap systems, sports racquets, and removable wrist strap assemblies that facilitate quick and easy connection and disconnection of a wrist strap from a sports racquet. By facilitating quick and easy connection and disconnection of the wrist strap from a sports racquet, the systems, racquets, and wrist strap assemblies permit a player to disconnect the wrist strap when the player no longer wishes to use the wrist strap. The disclosed systems, racquets, and wrist strap assemblies further permit the player to replace or exchange the wrist strap in circumstances such as when the wrist strap has become sweaty during play, such as when the wrist strap has been damaged and needs replacement, or such as when the player desires a different wrist strap having a different size or formed from a different material.

The example systems, racquets and wrist strap assemblies utilize a collar and an insert to releasably connect the wrist strap to the sports racquet. A flexible tether extending from an end a handle of the racquet secures one of the collar and the insert to the racquet. The other of the collar and the insert is connected to the wrist strap. The collar has an interior side opening and a side slot extending from the side opening. The insert is insertable into the interior through the side opening while portions of the wrist strap or flexible tether are insertable into the interior through the side slot. In a reverse fashion, the insert is removable from the interior through the side opening while portions of the wrist strap or flexible tether are removable from the interior through the side slot.

In some implementations, the insert is non-spherically shaped so as to be insertable through the side opening while at a predefined orientation. As a result, the chance of accidental dislodgment of the insert from the collar is reduced. In some implementations, the collar has major dimension along a longitudinal axis and a minor dimension less than the major dimension, wherein the side opening has a first maximum width transverse to the longitudinal axis of the collar and a second maximum width along the longitudinal axis of the collar. The insert has a major dimension along a longitudinal axis and a minor dimension, less than the major dimension, and transverse to the longitudinal axis of the insert. The major dimension of the insert is greater than the second maximum width of the side opening. The minor dimension of the insert is sized for insertion through the side opening when the longitudinal axis of the insert is perpendicular to the longitudinal axis of the collar. In some implementations, the minor dimension of the insert is less than or equal to the first maximum dimension of the side opening. In such implementations, the insert may be inserted into the collar and then rotated within the collar to an orientation in which the insert is locked into or captured within the collar.

In some implementations, the side slot has a maximum width transverse to the longitudinal axis of the collar. In some implementations, the collar is connected to the wrist strap, wherein portions of the flexible tether, connected to the sports racquet, comprise a pair of side-by-side cords and wherein the maximum width of the slot is less than a combined width of the pair of side-by-side cords.

In some implementations, at least portions of the collar are formed from a resiliently flexible polymer, facilitating resilient flexing of those portions of the collar about the side opening during pivoting or rotation of the insert within the collar. Such action provides the player with a tactile and/or audible indication of when the insert has been fully pivoted within the collar to complete the connection or to ready the insert for withdrawal from the collar. Moreover, the resilient flexibility of the collar about the side opening may facilitate a smaller size of the side opening to assist in preventing accidental dislodgment of the insert through the opening.

In some implementations, the handle of the racquet comprises a cavity extending from an end of the handle towards the head of the racquet. The flexible tether is secured to the handle within the cavity, concealing the connection of the flexible tether to the handle. Because the connection of the flexible tether to the handle is concealed, a more robust connection between the flexible tether and the handle may be provided. In some implementations, the handle further comprises an end cap, or butt cap, covering the cavity, wherein the flexible tether extends through the end cap.

In some implementations, the end of the handle comprise at least a partial ring. The flexible tether comprise a continuous cord having a fold or loop between opposite ends that are secured to one of the collar and the insert. The fold or loop is passed through the ring. Said one of the collar and insert is passed through the loop between the loop and the ring.

In some implementations, the flexible tether has an effective length of no greater than 5 mm extending from an end of the handle. For purposes of disclosure, the term "effective length" of the tether refers to the length of the tether from the axial end of the handle, and in some implementations, the end cap, to a proximal end of the insert or the collar, said one of which is directly connected to the flexible tether while the other of which is directly connected to the wrist strap. In some implementations, the flexible tether has an effective length of 2.5 mm beyond the surface of the end cap. As a result, the collar or insert directly connected to the flexible tether provides flexibility yet is sufficiently close to the axial end of the handle to reduce a likelihood of the insert and collar contacting or hitting the player's hand or wrist during play or contacting the butt end of the handle or the end cap during use. Such contact between the insert and collar and the player's hand, wrist or racquet handle might otherwise produce noise or might otherwise be annoying to the player. Moreover, in circumstances where the racquet is used without the wrist strap assembly, the short length of the tether may reduce the degree of possibly annoying dangling of the insert/collar connected directly to the tether.

In some implementations, the insert is directly connected to the flexible tether while the collar is directly connected to the wrist strap. In such implementations, the insert, sometimes referred to as a "pill", is sized smaller than the collar, having a lesser volume. When the wrist strap is not being used, the insert hangs from an axial end of the handle. In implementations where the insert is directly connected to the flexible tether rather than the collar, the smaller sized insert may be less conspicuous than the collar, may add a lesser amount of weight to the racquet as compared to the collar, and may be less likely to contact and/or catch upon the player during play.

Disclosed is an example sports racquet and removable system. The system may comprise a head, a handle coupled to the head, a flexible tether extending from an end of the handle, a wrist strap, and a wrist strap connector releasably connecting the wrist strap to the flexible tether. The wrist strap connector includes a collar and an insert. The collar is connected to one of the wrist strap and the flexible tether and has an interior having a side opening and a side slot extending from the side opening. The insert is connected to the other of the wrist strap and the flexible tether. The insert is insertable into the interior through the side opening while portions of the wrist strap or the flexible tether are insertable into the interior through the side slot.

Disclosed is a removable wrist strap assembly for a sports racquet having a flexible tether extending from an end of a handle of the sports racquet, the flexible tether being connected to one of a collar and an insert. The wrist strap assembly may comprise a wrist strap forming a loop to receive a person's hand and wrist, and the other of the collar and the insert connected to the loop. The collar has an interior having a side opening and a side slot extending from the side opening and wherein the insert is insertable into the interior through the side opening while portions of the wrist strap or the flexible tether are insertable into the interior through the side slot.

Disclosed is an example sports racquet for use with a wrist strap. The example sports racquet may comprise a head, a handle coupled to the head, a wrist strap connector for releasably connecting to the wrist strap, and a flexible tether having an effective length extending from an end of the handle to the wrist strap connector. Because the effective length is no greater than 5 mm, the wrist strap connector is less likely to bang or rattle about, or constitute a nuisance to the player wearing the wrist strap.

Disclosed is an example sports racquet for use with a wrist strap connected to one of a collar and an insert. The sports racquet may comprise a head, a handle coupled to the head, a flexible tether extending from an end of the handle, and the other of the collar and the insert connected to the flexible tether. The collar has an interior having a side opening and a side slot extending from the side opening and wherein the insert is insertable into the interior through the side opening while portions of the wrist strap or the flexible tether are insertable into the interior through the side slot.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

For purposes of this disclosure, the phrase "configured to" denotes an actual state of configuration that fundamentally ties the stated function/use to the physical characteristics of the feature proceeding the phrase "configured to". For purposes of this disclosure, the term "releasably" or "removably" with respect to an attachment or coupling of two structures means that the two structures may be repeatedly connected and disconnected to and from one another without material damage to either of the two structures or their functioning.

FIG. 1 illustrates an example sports racquet and removable wrist strap system 20. System 20 comprises sports racquet 24, wrist strap assembly 26-1 and wrist strap assembly 26-2 (collectively referred to as wrist strap assemblies 26). Sports racquet 24 comprises head 30, handle 34, flexible tether 38 and a wrist strap connector, in the form of an insert 42, for releasably connecting to either of wrist strap assemblies 26. Wrist strap assemblies 26-1 and 26-2 comprise collars 48 and wrist straps 46.

Head 30 comprises that portion of racquet 24 configured to strike a projectile used in a sporting activity. Examples of such projectiles include, but are not limited to, balls (e.g., padel balls, platform tennis balls, racquetball balls, tennis balls, pickle balls and the like) and shuttlecocks. In the example illustrated, head 30 has a stringed projectile striking region 47 for striking the projectile. In the example illustrated, head 30 is illustrated as being in the form of a racquetball racquet. In other implementations, the shape and stringing pattern of head 30 may have other configurations such as where racquet 24 is in the form of a tennis racquet or other stringed racquet. In some implementations, head 30 may alternatively have a non-strung projectile striking region 47. In such implementations, racquet 24 may be in the form of a padel paddle (FIG. 10), a platform tennis paddle, a pickleball paddle, a squash racquet, a badminton racquet, a table tennis racquet or other forms of racquet/paddles having solid or non-strung projectile striking regions 47. As should be appreciated, the size and shape of head 30 may vary depending upon the particular sport in which racquet 24 is to be utilized.

Handle 34 is directly or indirectly coupled to head 30 and provides a cylindrical or polygonal shaft about which a player's hand may grasp and hold racquet 24. Handle 34 extends in a direction away from head 30, terminating at an axial end 50, or a butt end. In some implementations, handle 34 may have an outer wrap of a leather, synthetic leather, rubber, fabric or other material to facilitate gripping of handle 34. In some implementations, handle 34 may omit such an outer wrap. In some implementations, handle 34 may have an outer texture to facilitate gripping of handle 34. In some implementations, handle 34 is indirectly coupled to head 30 by throat or neck region. Handle 34 may have a variety of different sizes and lengths depending upon the sport for which racquet 24 is configured to be used.

Flexible tether 38 comprises an elongate flexible or bendable cord, band, string or other flexible line extending from axial end 50 of handle 34. In some implementations, flexible tether 38 may be formed from a leather or synthetic leather material. In some implementations, flexible leather 38 may be formed from a rubber, synthetic rubber or polymer material. In some implementation, flexible tether 38 may be formed from a natural or synthetic fiber material. Flexible tether 38 has a first portion 51 proximate to the axial end 50 and a second portion 52 coupled to insert 44. In some implementation, flexible tether 38 may be directly affixed to the axial end 50 at the axial end 50 of handle 34. Such affixation may be by adhesives, welds, fasteners, catches, a loop, a rod, a bar or hook through or about which tether 38 is tied or looped, or the like. In some implementations, first portion 51 may extend beyond axial end 50 towards head 30. For example, in some implementations, first portion 51 is secured to handle 34 at a location within a recess or cavity extending from and into axial end 50 towards head 30.

In the example illustrated, the flexible tether 38 has an effective length of no greater than 5 mm extending from end 50 of the handle 34. In some implementations, flexible tether 38 has an effective length of at least 1 mm and no greater than 5 mm, and nominally 2.5 mm. As a result, flexible tether 38 has sufficient length to facilitate manual positioning and control over the orientation of insert for facilitating the insertion and withdrawal of insert 42 with respect to a collar 48 of removable wrist strap assembly 26-1 or 26-2, yet sufficiently limited in length to reduce a likelihood of the insert 42 and collar 48 contacting or hitting the player's hand or wrist during play or contacting the butt end or axial end 50 of the handle 34 during use. Such contact between the insert 42 and collar 48 and the player's hand, wrist or racquet handle might otherwise produce noise or might otherwise be annoying to the player. In some implementations, the flexible tether 38 has an effective length of 2.5 mm beyond axial end 50. In other implementations, the tether 38 can have an effective length that is greater than 5 mm.

Figure 2:
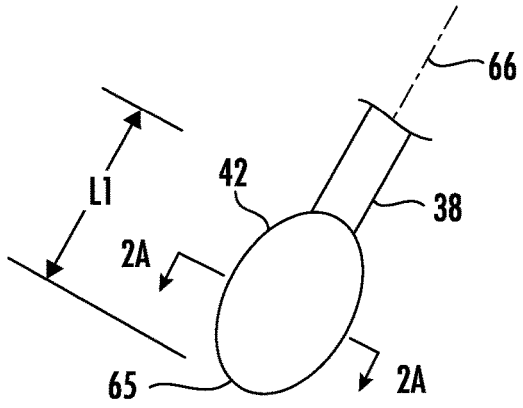
FIG. 2 is a perspective view illustrating an example insert and portions of an example flexible tether of the system of a removable wrist strap assembly of the system of FIG. 1.
Figure 2A:
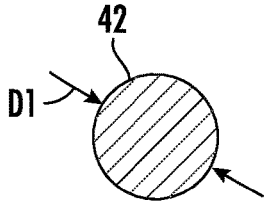
FIG. 2A is a sectional view of FIG. 2 taken along line 2A-2A.

As shown by FIG. 2, insert 42, sometimes referred to as a pill, is connected to portion 52 of flexible tether 38. In the example illustrated, insert 42 is non-spherical for one-way insertion/withdrawal with respect to an interior of a collar 48 associated with wrist strap assemblies 26. In the example illustrated, insert 42 has an oval bulbous shape having a length L1 and a width or diameter D1 (shown in FIG. 2A). In other implementations, insert 42 may have other non-spherical shapes. The non-spherical shape one-way insertion/withdrawal configuration of insert 42 assists in reducing accidental dislodgment of insert 42 from the interior of the collar 48. In other implementations, insert 42 may have a spherical shape for insertion/withdrawal with respect to an interior of a collar 48 associated with wrist strap assemblies 26.

Removal wrist strap assemblies 26 are configured to be releasably and interchangeably connected to racquet 24 through the interaction of insert 42 and collar 48 which cooperate to form a connector. Wrist straps 46 comprise loops sized or configured to extend about the wrist and/or hand that is grasping handle 34. Wrist straps 46 may be formed from a sweat absorbent material or a non-sweat absorbent material. Wrist straps 46 may be formed from a fabric material, a rubber material, a synthetic rubber material, a leather material, a synthetic leather material, a polymer or the like. Wrist straps 46 may comprise ropes or cords or may comprise bands.

Wrist strap 46 of the wrist strap assembly 26-1 has a different construction than the construction of wrist strap 46 of wrist strap assembly 26-2. In the example illustrated, wrist strap 46 of wrist strap assemblies 26-1 and 26-2 are differently sized. In the example illustrated, wrist strap 46 of wrist strap assembly 26-1 has a smaller diameter loop as compared to the diameter of the loop formed by wrist strap 46 of wrist strap assembly 26-2. In some implementations, the width or thickness of the different wrist straps 46 of the different wrist strap assemblies 26-126-2 may be different. For example, in implementations where wrist straps 26 comprise a band, one of wrist straps 46 may have a greater band width as compared to the other of wrist straps 46. In some implementations, wrist straps 46 of assemblies 26-1 and 26-2 are formed from different materials having different properties, such as different elasticity properties or different moisture absorbing properties. In other implementations, the wrist strap 46 may have a slip knot or looped structure that readily adjusts to the size of the user's wrist when worn.

Figure 3:
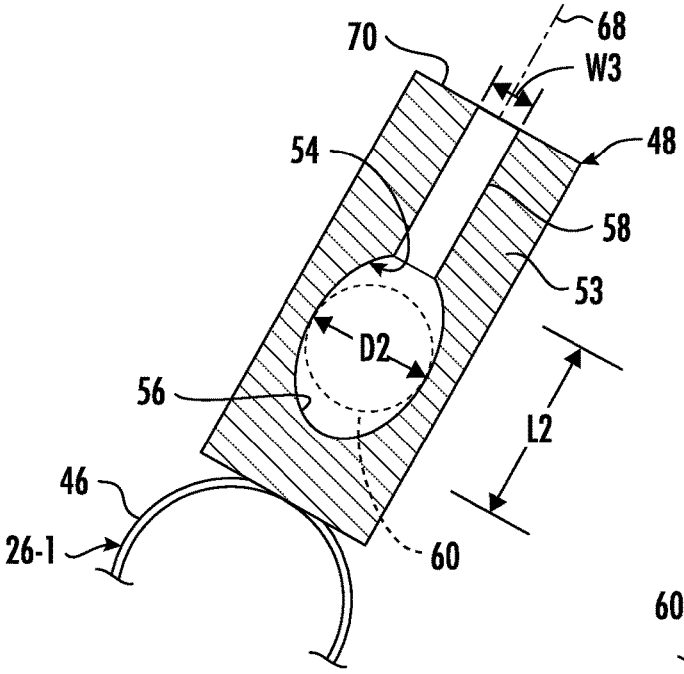
FIG. 3 is a cross-sectional view of an example collar and portions of an example wrist strap of the removable wrist strap assembly of FIG. 1.

Collar 48 and insert 42 form a wrist strap connector. Collars 48 of wrist strap assemblies 26 are similar to one another. FIG. 3 is a sectional view of an example collar 48. As shown by FIG. 3, collar 48 comprises a body 53 connected to wrist strap 46 and including an interior 54 configured to receive at least insert 42 with flexible tether 38 extending from insert 42 to an exterior of body 53. In the example illustrated, interior 54 comprises an insert receiving portion 56 and a tether passage 58 which are sized to concurrently receive insert 42 and portion 52 of flexible tether 38. In the example illustrated, portion 56 of interior 50 has a length L2 and a width or diameter D2. Length L2 is greater or equal to length L1 while diameter D2 is greater than or equal to diameter D1. Portion 58 of interior 54 has a width W3 greater than the thickness or width of portion 52 of flexible tether 38.

In other implementations where insert 42 is to have other shapes, portion 56 of interior 54 may also have a different shape configured to receive insert 42. In the example illustrated, portion 56 has a shape corresponding to the shape of insert 42. In other implementations, portion 56 of interior 54 may have shapes that do not necessarily correspond to the shape of insert 42, but which are sized to receive insert 42. Tether passage 58 of interior 54 extends from portion 56 to and through an axial end 70 of body 53.

Figure 4:
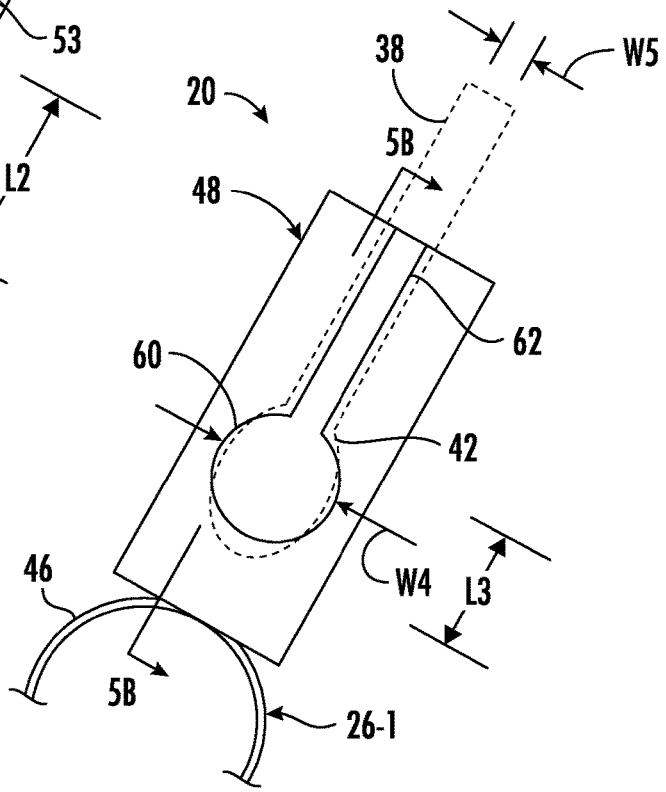
FIG. 4 is a diagram illustrating the example insert of FIG. 2 positioned within the example collar of FIG. 3 to removably or releasably connect the example removable wrist strap assembly to an example racquet.

FIG. 4 illustrates collar 48 receiving insert 42 and portion 52 of flexible tether 38. As shown by FIG. 4, collar 48 comprises a side opening 60 and a side slot 62. Side opening 60 is in communication with or opens into portion 56 of interior 54. Side opening 60 is configured to receive insert 42 when insert is in a particular orientation during such insertion. In the example illustrated, side opening 60 is configured to receive insert 42 when the nose 65 (shown in FIG. 2) is first inserted into side opening 60, such that the longitudinal axis 66 of insert 42 extends perpendicular to side opening 60, perpendicular to the longitudinal axis 68 along which tether passage 58 of interior 54 extends. In some implementations, side opening 60 has a width W4 greater than or equal to the width or diameter D1 of insert 42 and has a length L3 less than the length L1 of insert 42. In some implementations, the width W4 is less than the diameter D2 and the length L3 is less than the length L2 of interior 54 such that portion 56 of interior 54 forms an interior cavity dimensioned larger than the dimensions of side opening 60.

Side slot 62 is in communication with or opens into portion 58 of interior 54. Side slot 62 extends from side opening 60 to and through the axial end 70 of collar 48. Side slot 62 is configured to receive flexible tether 38 such that flexible tether 38 may extend from insert 42 (received within portion 56 of interior) out an axial end 70 of collar 48. In some implementations, side slot 62 has a width W5 greater than a corresponding width of flexible tether 38. In implementations, side slot 62 has a width W5 less than the width W3 and less than the width of flexible tether 38, wherein edge portions of side slot resiliently flex during insertion of tether 38 and/or wherein the diameter or thickness of tether 38 may be temporarily reduced during insertion such as by placing tether 38 in tension or pushing tether 38 through side slot 62.

In such implementations, portions of body 53 along side slot 62 may be resiliently flexible to accommodate the sideways insertion of flexible tether 38 through side slot 62 or the sideways withdrawal of flexible tether 38 through side slot 62. In some implementations, body 53 may be formed from an inflexible mass of material, but wherein regions of body 53 adjacent to side slot 62 are sufficiently thin or otherwise dimensioned so as to be resiliently flexible. In other implementations, the outer perimeter of side slot 62 may be formed from a material different than remaining portions of body 53. In some implementations, the outer edge of side slot 62 may have a resiliently flexible lip formed from a resiliently flexible material that is over molded or otherwise affixed to the remainder of body 53. For example, the outer edge of side slot 62 may be formed from a rubber, a synthetic rubber or other material that may be more resiliently flexible or elastic as compared to remaining portions of body 53.

In some implementations, the width W3 or the width W5 can be sized to receive only one portion of the tether 38. In other words, the tether 38 is typically a looped cord which has two portion extending from the insert or pill 42. In such implementations, the only way for the tether 38 to extend through the side slot 62 is if the tether portions enter the side slot 62 one at a time (one before the other) because the width W3 or W5 is too small to allow both portions of the tether 38 to enter the side slot 62 side by side. Such a configuration further inhibits the inadvertent disconnection or release of the strap assembly 26 from the handle 34.

Figure 5A:
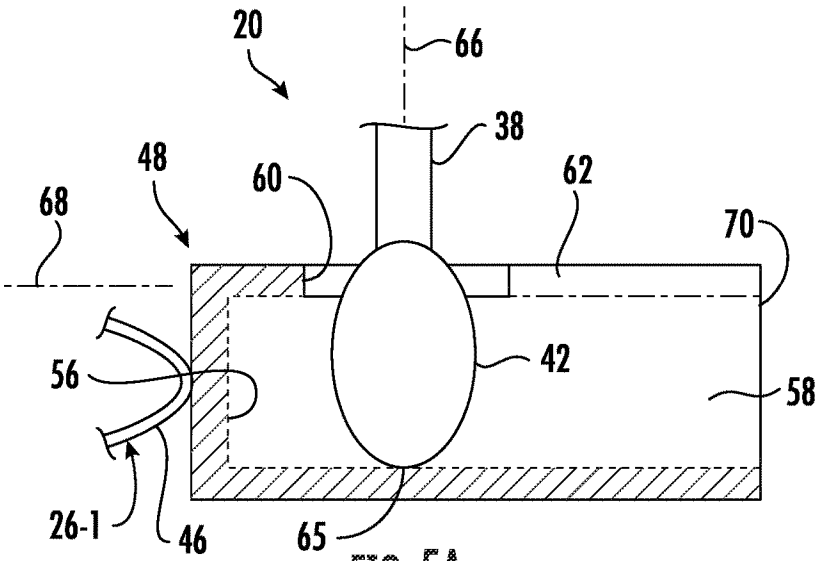
FIG. 5A is a sectional view through a longitudinal centerline of the example collar of FIG. 3 following initial insertion of the example insert of FIG. 2 into the example collar.
Figure 5B:
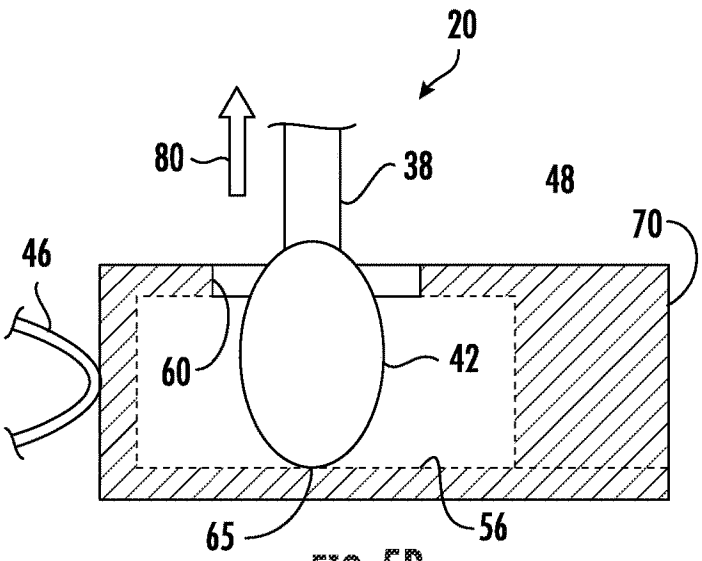
FIG. 5B is a sectional view through the example collar of FIG. 4 taken along the line 5B-5B following the initial insertion of the example insert of FIG. 2 into the example collar.
Figure 6A:
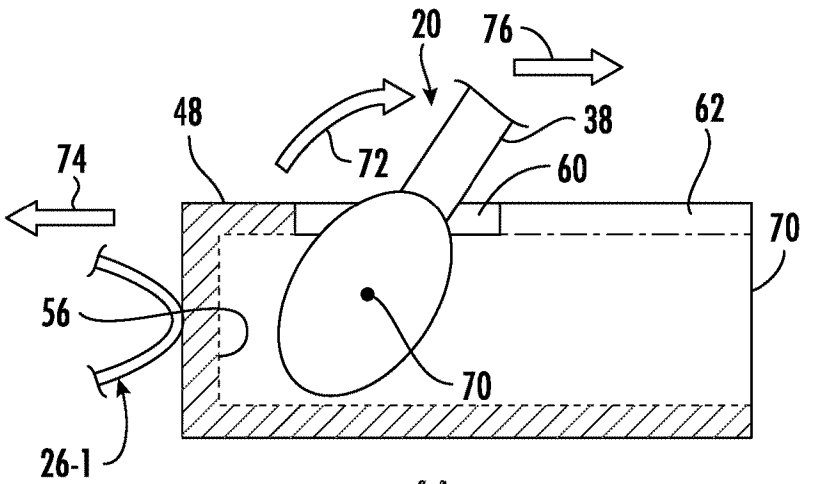
FIG. 6A sectional view through the example collar of FIG. 3 through it the longitudinal centerline of the example collar during pivoting of the example insert within an interior of the example collar.
Figure 6B:
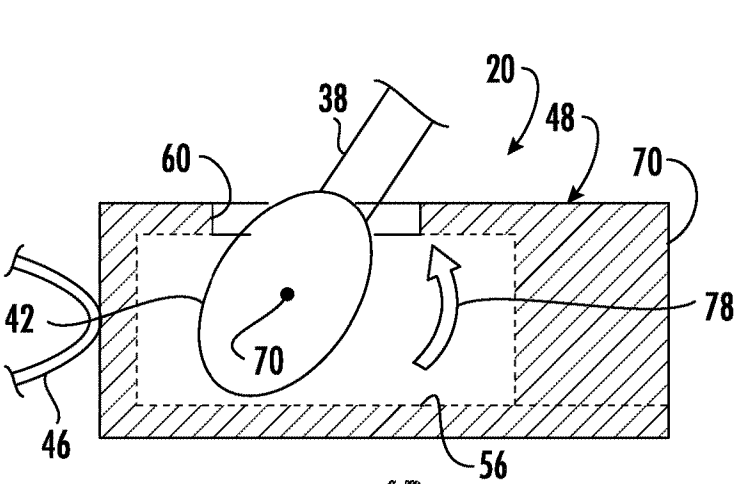
FIG. 6B is a sectional view through the example collar of FIG. 4 taken along the line 5B-5B during pivoting 6 of the example insert of FIG. 2 within an interior of the example collar.
Figure 7B:
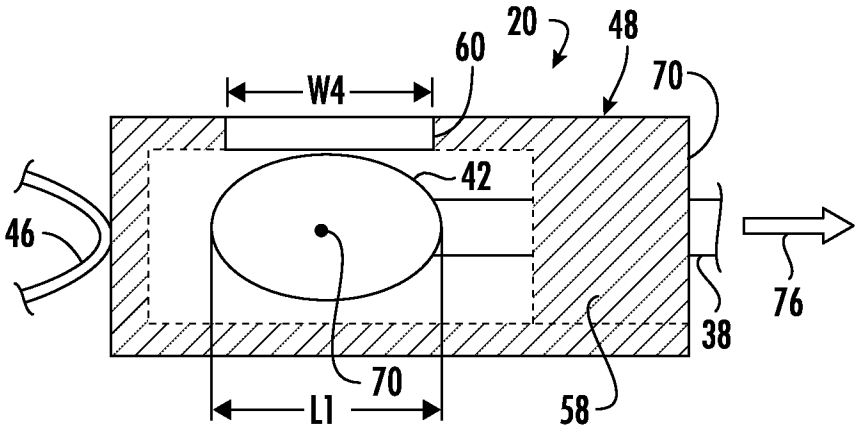
FIG. 7B is a sectional view through the example collar of FIG. 4 taken along the line 5B-5B following the pivoting of the example insert of FIG. 2 within an interior of the example collar.
Figure 7A:
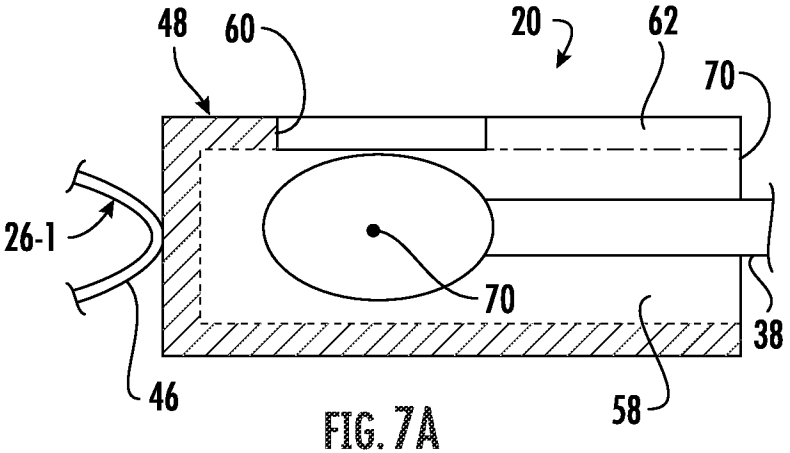
FIG. 7A is a sectional view through the example collar of FIG. 3 through the longitudinal centerline of the example collar following the pivoting of the example insert within an interior of the example collar.

FIGS. 5A, 5B, 6A, 6B, 7A and 7B illustrate one example method for connecting insert 42 to collar 48 so as to connect racquet 24 to removable wrist strap assembly 26-1 or 26-2. FIGS. 5A, 6A and 7A are taken along the longitudinal centerline of collar 48 during connection with insert 42. FIGS. 5B, 6B and 7B are taken through collar 48 along line 5B-5B of FIG. 4 during the connection of insert 42 to collar 48.

As shown by FIGS. 5A and 5B, connection of insert 42 to collar 48 may be initiated by centering the longitudinal axis 66 of insert 42 with respect to side opening 60, wherein axis 66 is perpendicular to the slot axis 68 along which slot 62 extends from side opening 60 to the end 70 of collar 48. Although the nose 65 is illustrated as being inserted until contacting the floor of interior portion 56, in other implementations, the insertion of insert 42 may be terminated prior to nose 65 reaching the floor of interior portion 56.

As shown by FIGS. 6A and 6B, once insert 42 has been sufficiently inserted into interior portion 56 of collar 48 through side opening 60, insert 42 is pivoted about its transverse axis 70 in the direction indicated by arrow 72, moving flexible tether 38 into and through side slot 62. Such pivoting may be achieved by pulling collar 48 in the direction indicated by arrow 74 while pulling flexible tether 38 in the direction indicated by arrow 76.

As shown by FIGS. 7A and 7B, pivoting of insert 42 about axis 70 may be continued until flexible tether 30 has been fully pulled through side slot 62 into the tether passage 58 and such that flexible tether 38 extends through and beyond end 70 of collar 48. In the position shown in FIGS. 7A and 7B, during use of wrist strap 46, forces upon flexible tether 38 occur in the direction indicated by arrow 76, wherein collar 48 inhibits the withdrawal of insert 42. In addition, because length L1 of insert 42 is greater than the length L3 of side opening, insert 42 cannot be withdrawn in a sideways fashion through side opening 60.

When the currently connected wrist strap assembly 26-1 is to be disconnected from racquet 24, the reverse process may be carried out. In particular, insert 42 is first rotated about axis 70 in the direction indicated by arrow 78 in FIG. 6B. During such pivoting, flexible tether 38 is pulled through side slot 62 and withdrawn from tether passage 58. Such pivoting is continued until axis 66 of insert 42 is once again perpendicular to the slot axis 68. Once in the position shown in FIGS. 5A and 5B, flexible tether 38 and insert 42 may be pulled in the direction indicated by arrow 80 in FIG. 5B to withdraw insert 42 through side opening 60 and from interior portion 56, disconnecting racquet 24 from the removable wrist strap assembly 26-1.

Figure 8B:
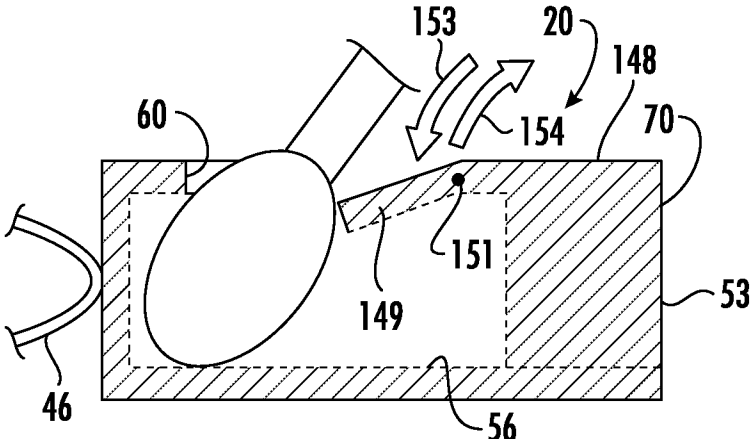
FIG. 8B is a sectional view through the example collar of FIG. 8A taken along the line 5B-5B during the pivoting of the example insert within an interior of the example collar.
Figure 8A:
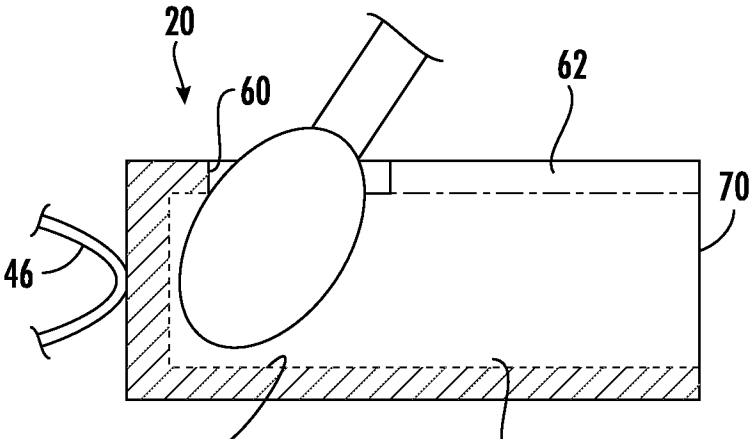
FIG. 8A sectional view through an example collar through the longitudinal centerline of the example collar during pivoting of an example insert within an interior of the example collar.

FIGS. 8A and 8B are sectional views illustrating racquet and removable wrist strap system 20 comprising an alternative collar 148 in place of collar 48 described above. FIG. 8A is a sectional view taken along a longitudinal centerline of collar 148 while FIG. 8B is a sectional view taken along line 5B-5B of FIG. 4. FIGS. 8A and 8B illustrate an example of how side opening 60 may be made smaller to more securely retain insert 42 within collar 48 and to more securely retain system 20 in a connected state.

Collar 148 is similar to collar 48 except that side opening 60 is smaller and that portions of collar 148 adjacent to or about side opening 60 are resiliently flexible. In the example illustrated, those portions of body 53 adjacent to side opening 60 are resiliently flexible to flex during insertion of insert 42 into and withdrawal of insert 42 from portion 56 of interior 54. In the example illustrated, body 53, or at least portions of body 53 about side opening 60 are formed from a resiliently flexible material configured to resiliently flex in response to pivoting of insert 42 within interior portion 56. As shown by FIG. 8B, during pivoting of insert 42, portion 149 of collar 148 may flex downwardly (pivoting about a living hinge 151 in the direction indicated by arrow 153) as insert 42 is pivoted to the orientation shown in FIG. 7B. Once it is pivoted past this point, portion 149 may result only returned to the position or state shown FIG. 7B. Conversely, during withdrawal of insert 42 and disconnection of removable wrist strap assembly 26-1 portion 149 may pivot about the living hinge 151 in the direction indicated by arrow 154 until insert 42 has attained the orientation shown in FIG. 5B, ready for withdrawal from interior portion 56. Such resilient flexing permits insert 42 to be snapped or popped into interior 54, creating a tactile and/or audible sensation confirming full receipt of insert 42 into the interior of collar 48. Upon resiliently returning to their initial states, portion 149 assists in retaining insert 42 and flexible tether 38 within the interior 54 of collar 48.

In some implementations, body 53 may be formed from an inflexible mass of material, but wherein regions of body 53 adjacent to side opening 60 are sufficiently thin or otherwise dimensioned so as to be resiliently flexible. In other implementations, portion 149 adjacent to side opening 60 may be formed from a material different than remaining portions of body 53. In some implementations, portion 149 may comprise a resiliently flexible lip formed from a resiliently flexible material that is over molded or otherwise affixed to the remainder of body 53. For example, portion 149 may be formed from a rubber, a synthetic rubber or other material that may be more resiliently flexible or elastic as compared to remaining portions of body 53.

Insert 42 and collar 48 facilitate quick and easy disconnection of wrist strap assembly 26-1 from racquet 24. As a result, a player may disconnect the wrist strap assembly 26-1 when the player no longer wishes to use the wrist strap 26-1. The player may also easily and quickly replace or exchange the wrist strap 26-1 in circumstances such as when the wrist strap has become sweaty during play, such as when the wrist strap has been damaged and needs replacement, or such as when the player desires a different wrist strap, such as wrist strap assembly 26-2, having a different size or formed from a different material.

Figure 9:
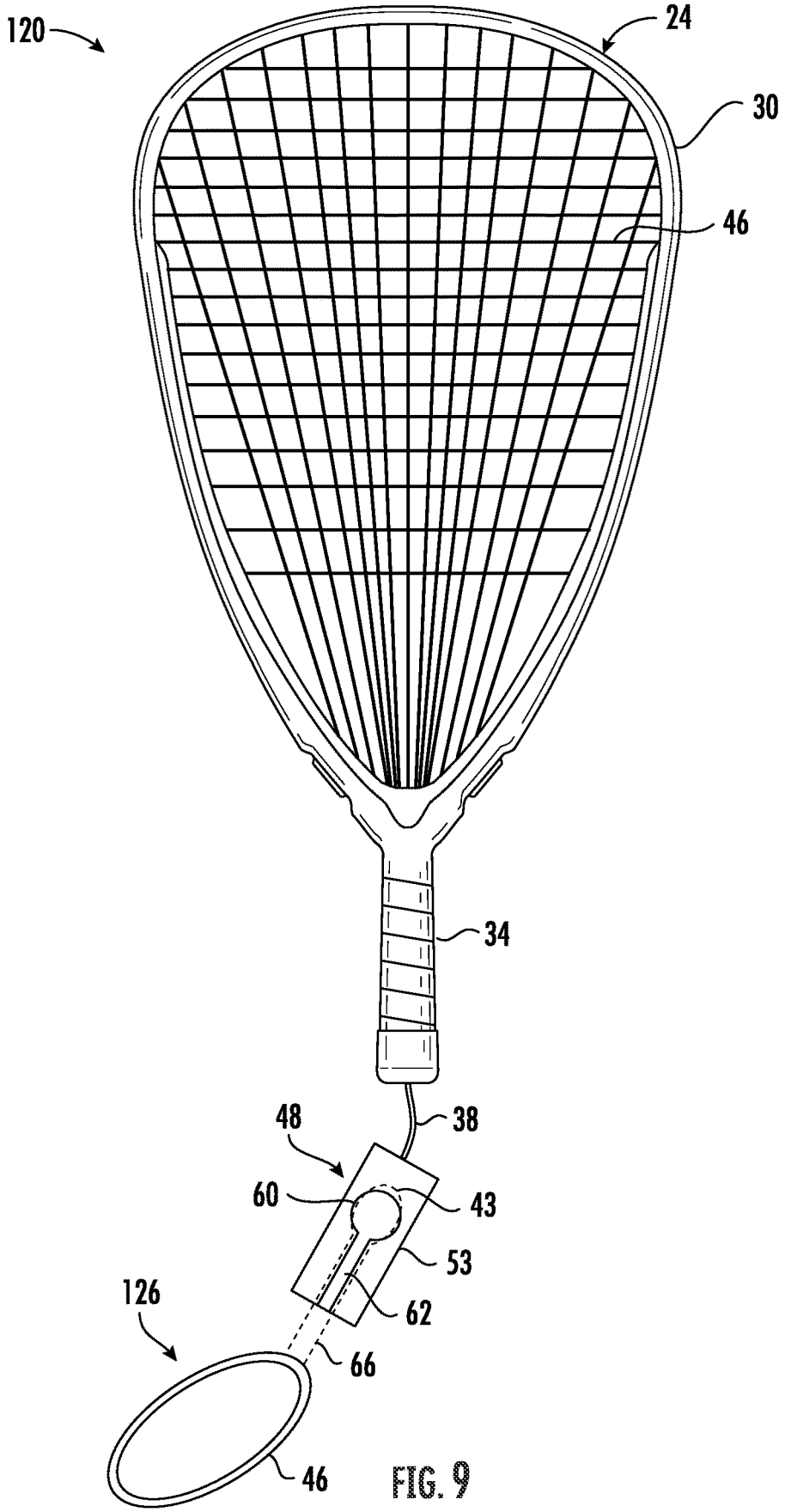
FIG. 9 is a perspective view of an example sports racquet and removable wrist strap system.

FIG. 9 illustrates portions of an example sports racquet and removable wrist strap system 120. System 120 is similar to system 20 described above except that insert 42 is coupled to wrist strap 46 of wrist strap assembly 126 and that collar 48 is connected to flexible tether 38. The remaining components of system 120 which correspond to components of system 20 are numbered similarly.

As shown by FIG. 9, insert 42 and collar 48 are similar to insert 42 and collar 48 of system 20 except for the alternative connections and orientations of such components. Side slot 62 extends from side opening 60 in a direction away from location at which flexible tether 38 connects to body 53 of collar 48. Side slot 62 extends from side opening 60 in a direction towards wrist strap 46 of wrist strap assembly 126. Instead of receiving flexible tether 38, side slot 62 receives a strap, cord, band or other flexible line 66 which is connected to insert 42 at one and which is connected to or is formed as part of wrist strap 46 at the other end. As with tether 38 of system 20, side slot 62 of system 120 facilitates sideways insertion and passage of a portion of wrist strap 46 (flexible line 66) through a side of body 53 into tether passage 58 of interior 54 (shown in FIGS. 3 and 4).

Similar to system 20, system 120 facilitates quick and easy disconnection of wrist strap assembly 26-1 from racquet 24. As a result, a player may disconnect the wrist strap assembly 126 when the player no longer wishes to use the wrist strap assembly 126. The player may also easily and quickly replace or exchange the wrist strap assembly 126 in circumstances such as when the wrist strap has become sweaty during play, such as when the wrist strap assembly 126 has been damaged and needs replacement, or such as when the player desires a different wrist strap assembly having a different wrist strap size or a wrist strap formed from a different material.

Figure 10:
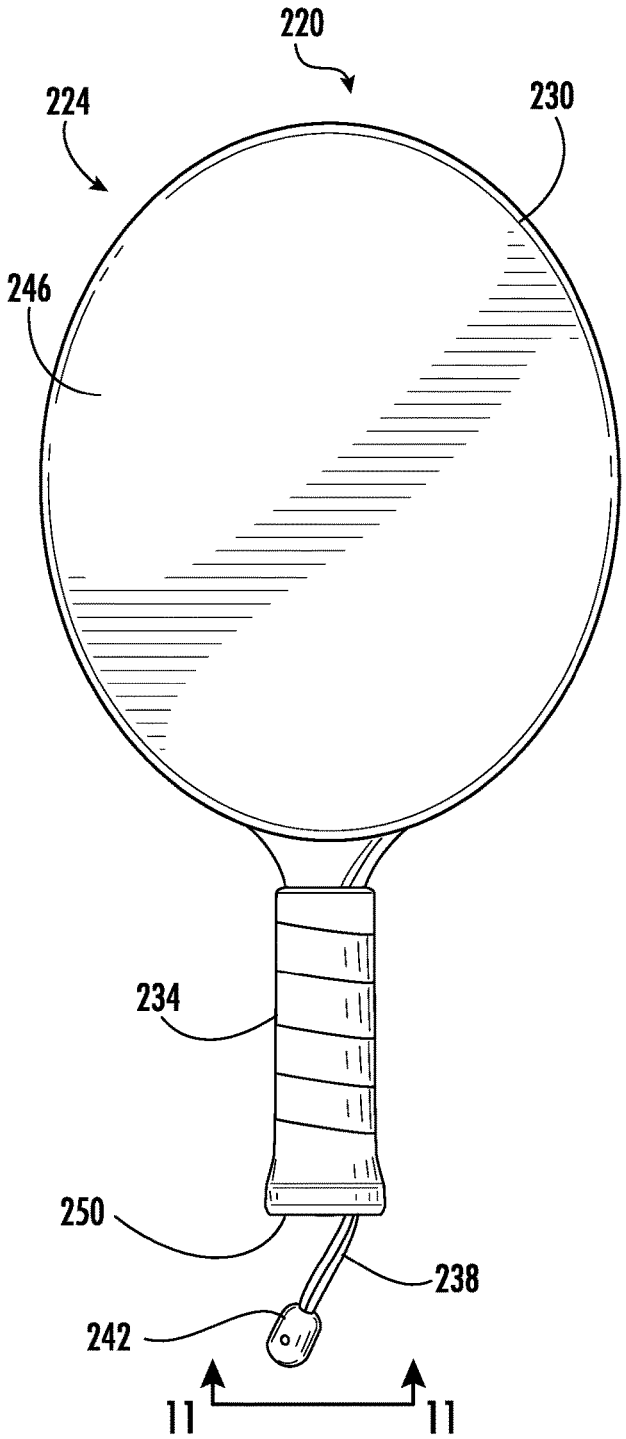
FIG. 10 is a perspective view of an example sports racquet of an example sports racquet and removable wrist strap system.

FIG. 10 illustrates an example sports racquet 224 or sports paddle, which is part of a larger sports racquet and removable wrist strap system 220. Sports racquet 224 comprises head 230, handle 234, flexible tether 238 and insert 242. Sports racquet 224 is for use with the example removable wrist strap assembly 226 shown in FIG. 13 and comprising wrist strap 246 and collar 248.

Head 230 is similar to head 30 described above in that head 230 comprise a widened and enlarged portion of racquet 224 configured for striking a projectile. In contrast to head 30, head 230 comprises a non-strung projectile striking region 246. In some implementations, region 246 is imperforate. In some implementations, region 246 may include perforations or openings. In some implementations, head 230 may be configured as part of a padel paddle, a pickle ball paddle, a platform tennis paddle or other forms of paddles which utilize solid, hollow, celled, or non-strung projectile striking regions. As should be appreciated, the size, shape and exact nature of head 230 may vary depending upon the projectile to be struck and the sport in which racquet or paddle 224 is to be used.

Handle 234 is similar to handle 34 in that handle 234 provides a cylindrical or polygonal shaft about which a player's hand may grasp and hold racquet 224. Handle 234 extends in a direction away from head 30, terminating at an axial end 250, or butt end. In some implementations, handle 234 may have an outer wrap of a leather, synthetic leather, rubber, fabric or other material to facilitate gripping of handle 234. In some implementations, handle 234 may omit such an outer wrap. In some implementations, handle 234 may have an outer texture to facilitate gripping of handle 234. In some implementations, handle 34 is indirectly coupled to head 230 by throat or neck region. Handle 234 may variety of different sizes and lengths depending upon the sport for which racquet 224 is configured to be used.

Figure 11:
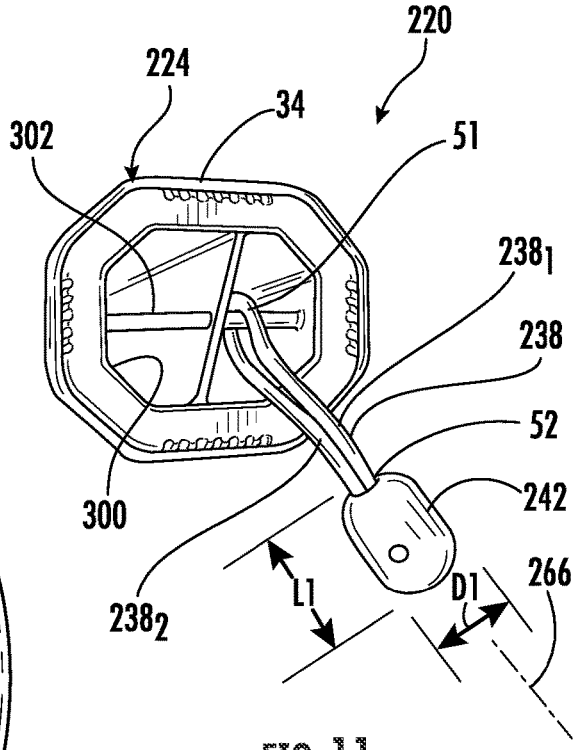
FIG. 11 is an end view of the example sports racquet of FIG. 10 taken along line 11-11.

As shown by FIG. 11, handle 234 comprises a cavity 300 projecting from the axial end 250 of handle 234 towards head 230. Handle 234 further comprises a rod 302 located within cavity 300 and about which flexible tether 238 may be tied or are otherwise secured. In other implementations, handle 234 may comprise a panel or other structure within cavity 300 that comprises an opening through which flexible tether 238 may be tied or otherwise secured.

Flexible tether 238 comprises an elongate flexible or bendable cord, band, string or other flexible line having a first portion 251 secured to rod 300 within cavity 300 and a second portion 252 secured to insert 242. In the example illustrated, flexible tether 238 comprises a single line, the opposite ends of which are both affixed to insert 242. In some implementations, those portions of flexible tether 238 between the ends secured to insert 242, form a loop which wraps about rod 302. In some implementations, an entirety of the loop is wrapped about rod 302, wherein insert 242 is then passed through the loop, between rod 302 and the loop to secure flexible tether 238 to rod 302. In yet other implementations, flexible tether 238 may be secured to rod 302 or other structures within cavity 300 in other fashions.

In some implementations, flexible tether 238 may be formed from a leather or synthetic leather material. In some implementations, flexible leather 238 may be formed from a rubber, synthetic rubber or polymer material. In some implementations, flexible tether 38 may be formed from a natural or synthetic fiber material.

In the example illustrated, the flexible tether 238 has an effective length of no greater than 5 mm extending from an end 250 of the handle 234. In some implementations, flexible tether has an effective length of at least 1 mm and no greater than 5 mm, and nominally 2.5 mm. As a result, flexible tether 238 has sufficient length to facilitate manual positioning and control over the orientation of insert 242 for facilitating the insertion and withdrawal of insert 242 with respect to a collar 248 of removal wrist strap assembly 226, yet sufficiently limited in length to reduce a likelihood of the insert 242 and collar 248 contacting or hitting the player's hand or wrist during play or contacting the butt end or axial end 250 of the handle 234 during use. Such contact between the insert 242 and collar 248 and the player's hand, wrist or racquet handle might otherwise produce noise or might otherwise be annoying to the player. In some implementations, the flexible tether 238 has an effective length of 2.5 mm beyond axial end 250. In other implementations, the tether 238 can have a length greater than 5 mm.

As shown by FIG. 11, insert 242, sometimes referred to as a pill, is non-spherical for one-way insertion/withdrawal with respect to an interior of a collar 548 associated with wrist strap assembly 226. In the example illustrated, insert 242 has an oval bulbous shape having a length L1 and a diameter D1. In other implementations, insert 242 may have other non-spherical shapes. The non-spherical shape, one-way insertion/withdrawal configuration of insert 242 assists in reducing accidental dislodgment of insert 242 from the interior of the collar 248. In other implementations, insert 242 may have a spherical shape for insertion/withdrawal with respect to an interior of a collar 248 associated with wrist strap assembly 26.

Figure 12:
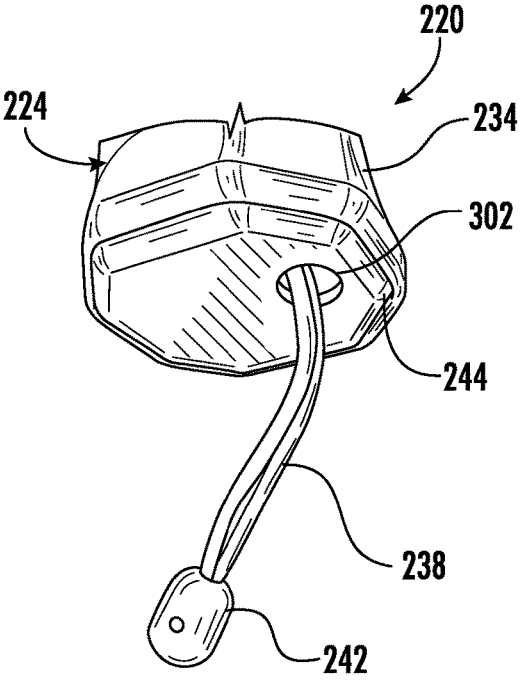
FIG. 12 is a perspective view of the example sports racquet of FIG. 10 with an example end cap.

As shown by FIG. 12, handle 234 further comprises an end cap 244, or a butt cap, covering cavity 300. End cap 244 further comprises opening 302 through which flexible tether 238 extends. In some implementations, opening 302 is sized smaller than the smallest dimension of insert 242 to inhibit insert 242 from being pulled or otherwise moved into cavity 300. In some implementations, end cap 244 may be omitted.

Figure 13:
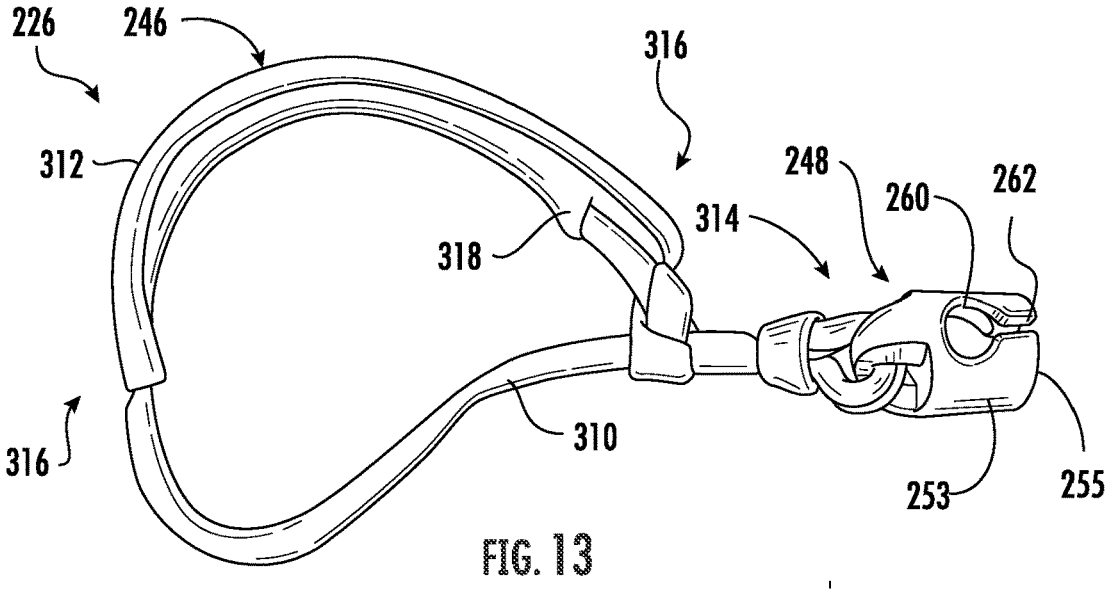
FIG. 13 is a perspective view of an example removable wrist strap assembly of the example sports racquet and removable wrist strap system of FIG. 10.

As shown by FIG. 13, wrist strap 46 comprises strap 310 and padding 312. Strap 310 comprises an elongate fabric strap having a first end 314 tied to collar 248 and a second end stitched or otherwise fastened to itself to form a loop 318 about an intermediate portion of strap 310. Padding 312 comprises a layer of compressible material affixed to strap 310 between end 318 and loop 316. The overall size of the wrist receiving portion of wrist strap 246 may be adjusted by sliding portions of strap 310 through the loop 318. In other implementations, wrist strap 246 may omit padding 312, be formed from other materials, or may have other configurations.

Figure 14:
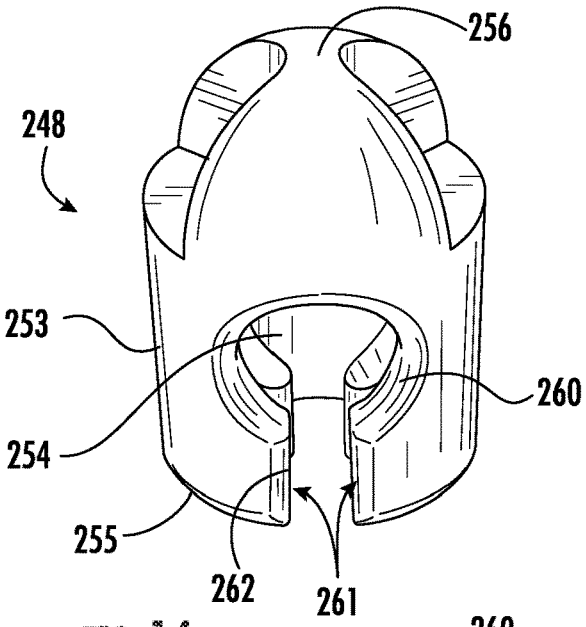
FIG. 14 is a front perspective view of an example collar of the example removable wrist strap assembly of FIG. 13.
Figure 15:
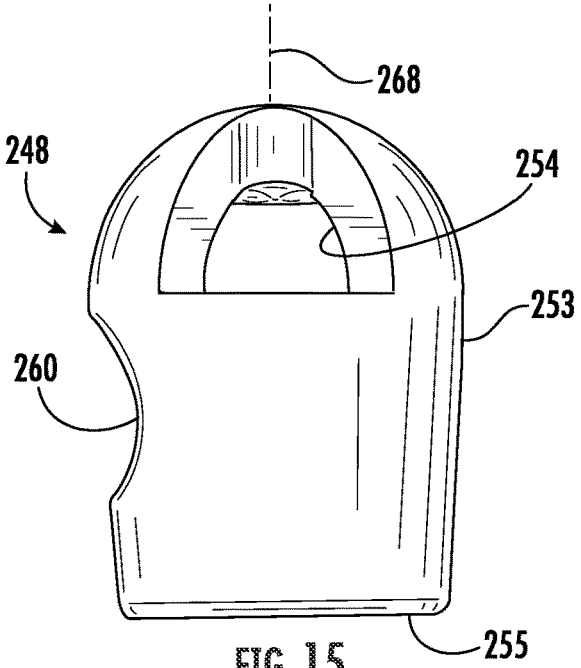
FIG. 15 is a side perspective view of the example collar of FIG. 14.
Figure 16:
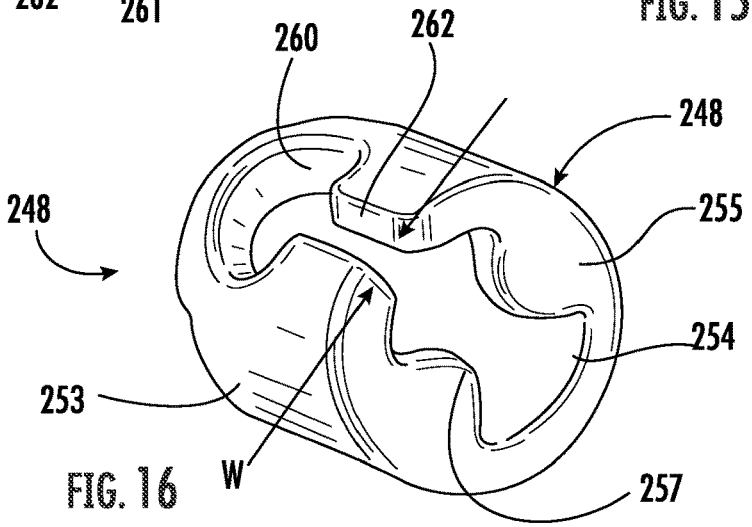
FIG. 16 is a perspective view of the example collar of FIG. 14.

Collar 248 is connected to end 314 of strap 310. FIGS. 14, 15 and 16 illustrate collar 248. Collar 248 comprises a body 253 having an interior 254, a first axial end 255 and a second axial end 256. Interior 254 is sized to receive insert 242 when the longitudinal axis 266 of insert 242 (shown in FIG. 11) is oriented perpendicular to the longitudinal axis 268 of collar 248 and when the longitudinal axis 266 of insert 242 is parallel to the longitudinal axis 268 of collar 248. Interior 254 is further sized to facilitate pivoting of insert 242 between a first position where the longitudinal axis 266 of insert 242 is perpendicular to the longitudinal axis 268 and a second position in which the longitudinal axis 266 is parallel to the longitudinal axis 268. As shown by FIG. 16, interior 254 forms a tether passage 257 that opens through the axial end 255 of collar 248.

Collar 248 further comprises side opening 260 and side slot 262. Side opening 260 extends through a side of body 253 and opens into interior 254. In the example illustrated, side opening 260 comprises a circular opening having a diameter equal to or slightly larger than diameter D1 of insert 242 but less than the length L1 of insert 242. Although illustrated as being circular, in other implementations, side opening 260 may have other shapes while limiting the insertion of insert 242 into interior 254 to a predefined orientation or set of orientations.

Side slot 262 extends from side opening 260 to the end 255 of collar 248. Side slot 262 opens into the interior 254. In the example illustrated, side slot 262 is sized to allow flexible tether 238 (shown in FIGS. 10-12) to pass therethrough into interior 254. In the example illustrated, side slot 262 has a width W sized to receive a single one of the two lines forming flexible tether 238, while inhibiting the concurrent side-by-side passage of both of the lines 238-1 and 238-2 (shown in FIG. 11) therethrough. In contrast, side slot 262 is sized to allow consecutive movement or passage of lines 238-1 and 238-2 through side slot 262 into interior 254 and through the axial opening 257 of collar 248. As a result, the width of side slot 262 inhibits accidental withdrawal of flexible tether 238 through side slot 262.

In other implementations, side slot 262 may have other widths. For example, side slot 262 may have a width which may necessitate constriction of each of lines 238-1 and 23-2 during consecutive passage of the lines of flexible tether 238 through side slot 262 (requiring one by one passage of the lines 238-1 and 238-2 through the side slot 262). In some implementations, side slot 262 may have a greater width to allow concurrent side-by-side passage of lines 238-1 and 238-2 through side slot 262. In some implementations, flexible tether 238 may be formed from a single line rather than a pair of lines.

In some implementations, portions of collar 248 adjacent to or about side opening 260, such as portions 261 shown in FIG. 14, may be dimensioned or formed from materials so as to resiliently flex during pivoting of the example insert 242 within interior 254. In such implementations, a relative size difference between the size of side opening 260 and the length L1 of insert 242 may be greater, potentially more reliably retaining the insert 242 within interior 254. In addition, the flexing of portions 261 during the pivoting of the insert 242 within interior 254, following insertion of insert 242 or prior to withdrawal of insert 242, may provide an audible or tactile sensation to indicate the completion of such pivoting. In yet other implementations, opening 260 and interior 254 may be sized relative to insert 242 to permit pivoting of insert 242 without flexing or deformation of portions of collar 248.

FIGS. 17-22 illustrate an example method for connecting racquet 224 to removable wrist strap assembly 226. Although FIGS. 17-22 illustrate racquet 224 without end cap 244, it should be appreciated that in some implementations, racquet 224 may be additionally provided with end cap 244. The connection of racquet 224 to removable wrist strap assembly 226 may be carried out with end cap 244 in place.

Figure 17:
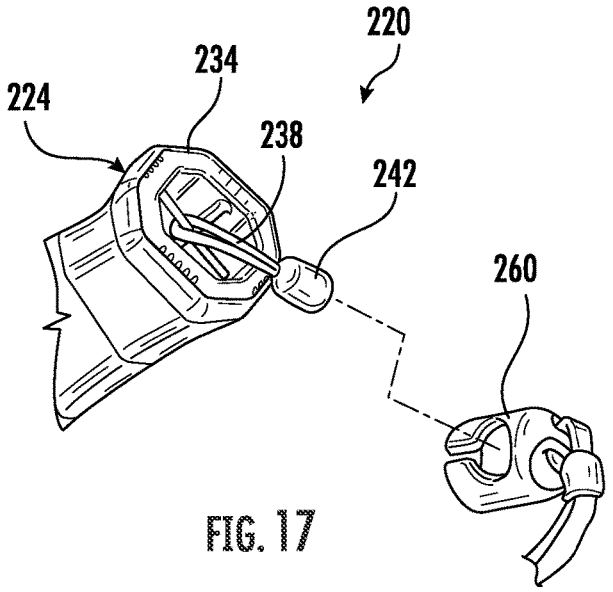
FIG. 17 is a perspective view illustrating positioning of the example sports racquet of FIG. 10 with respect to the example removable wrist strap assembly of FIG. 13.
Figure 18:
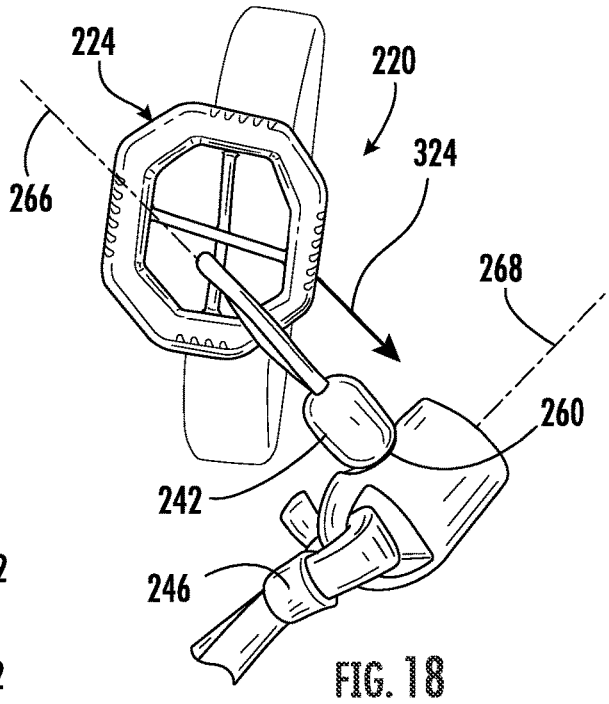
FIG. 18 is a perspective view illustrating alignment and example insert of the example racquet of FIG. 10 with an example side opening of an example collar of the example removable wrist strap assembly of FIG. 13.

As shown by FIGS. 17 and 18, insert 242 is aligned with side opening 260 such that the longitudinal axis 266 is centered with respect side opening 260 such that longitudinal axis 266 is perpendicular to longitudinal axis along which side slot 262 extends. As indicated by arrow 324, insert 242 is inserted into side opening 260 until insert 242 is received within the interior 254 of collar 248 as shown in FIG. 19.

Figure 19:
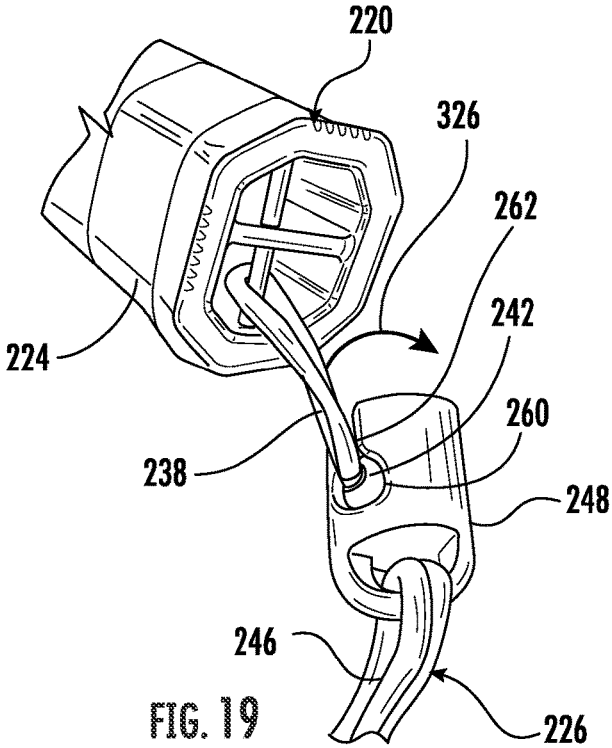
FIG. 19 is a perspective view illustrating insertion of the insert of FIG. 18 into the collar of FIG. 18.
Figure 20:
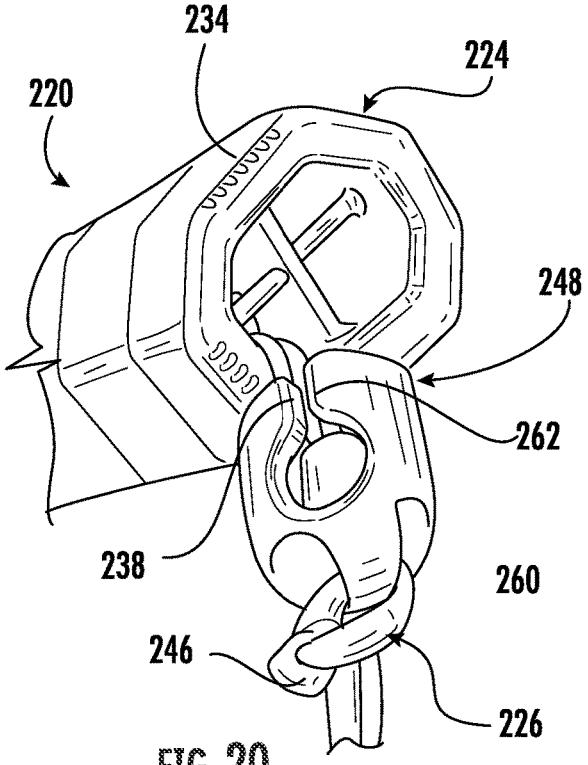
FIG. 20 is a perspective view illustrating an example flexible tether of the example racquet of FIG. 10 after being passed through an example side slot of the example collar.
Figure 21:
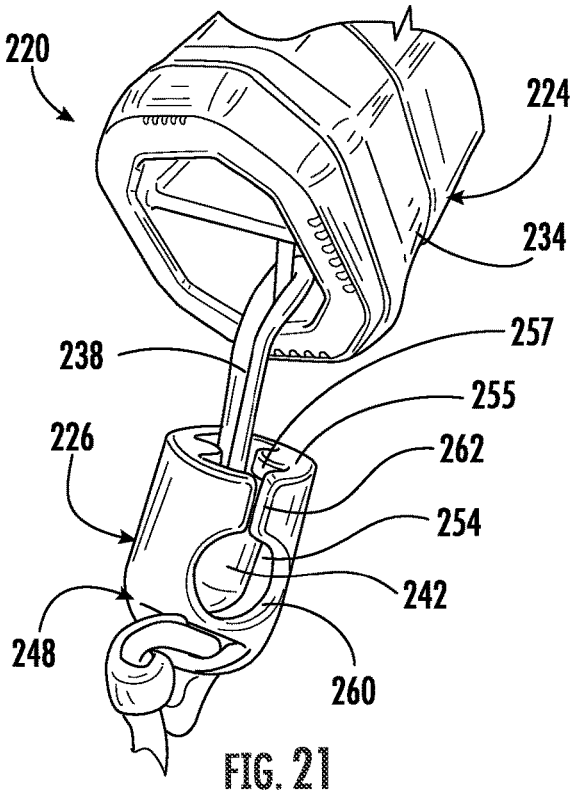
FIG. 21 is a perspective view illustrating the example insert within the example collar and the example flexible tether extending from the collar.
Figure 22:
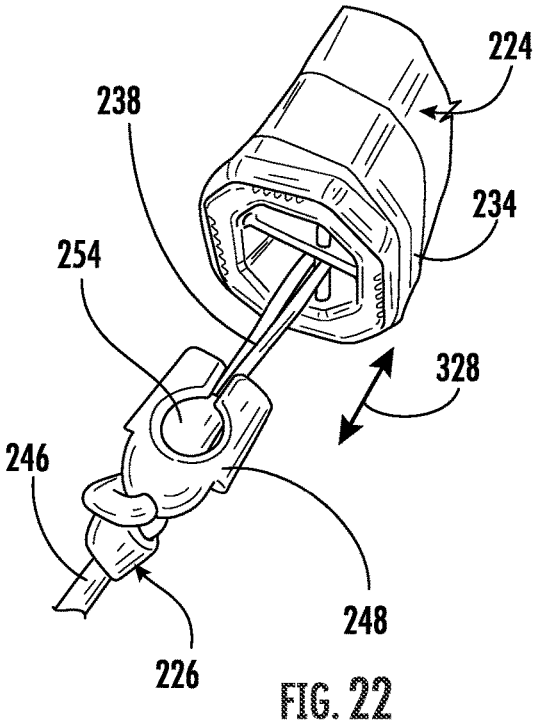
FIG. 22 is a perspective view illustrating a connection between the example racquet and the example removable wrist strap assembly provided by the example collar and the received example insert.

As further shown by FIG. 19, once insert 242 has passed through side opening 260, flexible tether 238 is pulled through side slot 262 as indicated by arrow 326. During such action, lines 238-1 and 238-2 of flexible tether 238 are stacked upon one another and are consecutively moved through side slot 262. FIG. 20 illustrates flexible tether 238 after flexible tether 238 has been passed through side slot 262. As shown by FIG. 21, both lines of flexible tether 238 extend through the tether passage 257 and through the end 255 of collar 248. As shown by FIG. 22, collar 248 retains insert 242 within interior 254 despite forces in the direction indicated by arrows 328.

To disconnect racquet 224 from removable wrist strap assembly 226, insert 242 is removed from the interior 254 of collar 248. When the currently connected wrist strap assembly 226 is to be disconnected from racquet 224, the reverse process may be carried out. In particular, insert 242 is first rotated so as to pull flexible tether 38 through side slot 262. During such pulling, lines 238-1 and 238-2 of tether 238 are stacked so as to consecutively pass through side slot 262. Pulling of flexible tether 238 through side slot 262 pivots insert 242 from the position shown in FIG. 22 in which the longitudinal axis 266 of insert 242 (shown in FIG. 11) extends parallel to the longitudinal axis 268 of collar 248 (shown in FIG. 15) to the orientation shown in FIG. 18 in which the longitudinal axis 266 of insert 242 extends perpendicular to the longitudinal axis 268 of collar 248. Once in the perpendicular orientation shown FIG. 18, within collar 48, insert 242 may be pulled and withdrawn from collar 248, through side opening 260, disconnecting racquet 224 from removable wrist strap assembly 226. Thereafter, racquet 224 may be used without a removable wrist strap assembly or a different wrist strap assembly may be connected to racquet 224 in the same fashion described above with respect to FIGS. 17-22.

Figure 23:
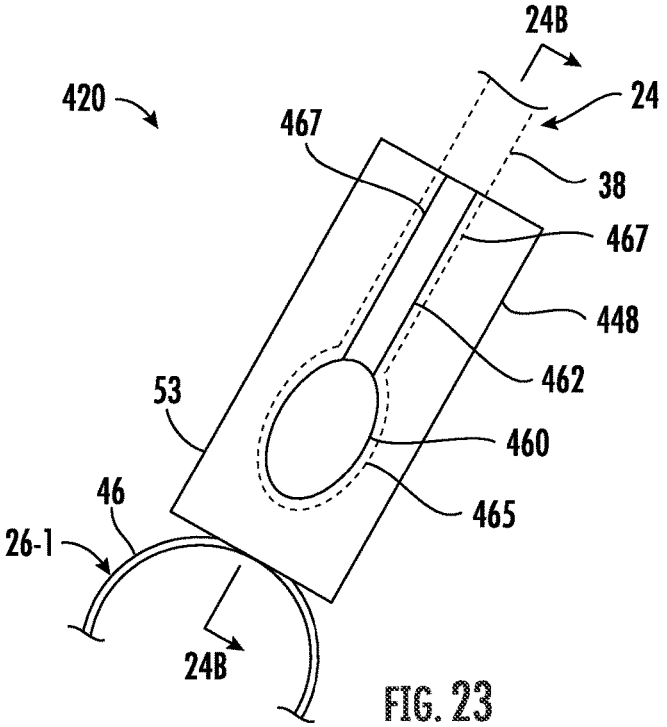
FIG. 23 is a diagram illustrating the example insert of FIG. 2 positioned within an example collar to removably or releasably connect the example removable wrist strap assembly to an example racquet.
Figure 24A:
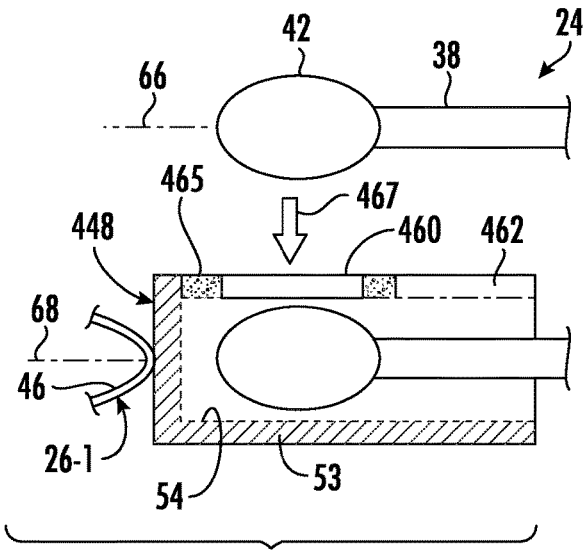
FIG. 24A is a sectional view through a longitudinal centerline of the example collar of FIG. 23 illustrating insertion of the example insert of FIG. 2 into the example collar.
Figure 24B:
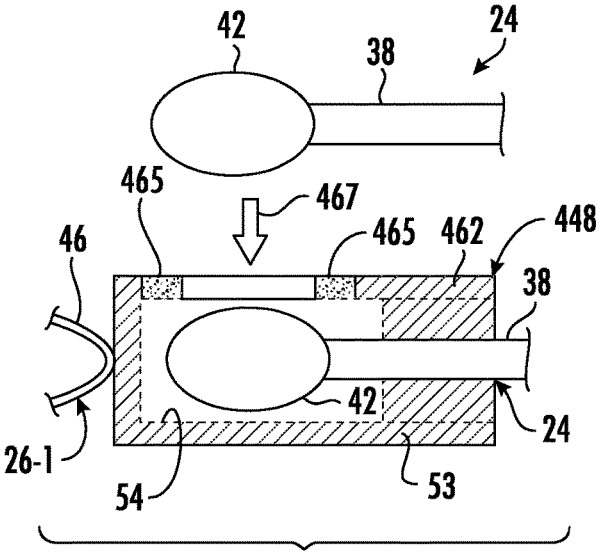
FIG. 24B is a sectional view through the example collar of FIG. 23 taken along the line 24B-24B following the initial insertion of the example insert of FIG. 2 into the example collar.

FIGS. 23, 24A and 24B illustrate an example sports racquet and removable wrist strap system 420. FIGS. 23, 24A and 24B illustrate another example collar 448 for releasably retaining insert 42 and connecting racquet 24 (shown in FIG. 1) to a removable wrist strap assembly, such as assembly 26-1. Those components of system 420 which correspond to components of system 20 are numbered similarly and/or are shown in FIGS. 1-4.

Collar 448 is similar to collar 48 described above except that collar 448 comprises side opening 460 and side slot 462. Side opening 460 is sized smaller than insert 42, but is bordered by resiliently flexible rim 465. Rim 465 extends about side opening 460 and is sufficiently large and sufficiently flexible so as to bend or flex during the insertion of insert 42 into the interior 54 of collar 448 as indicated by arrow 467. Likewise, rim 465 is sufficiently large and sufficiently flexible so as to bend or flex during the withdrawal of insert 42 from the interior 54 of collar 448. As a result, insert 42 may be inserted into interior 54 in a sideways orientation, wherein axis 66 of insert 42 is parallel to axis 68 of collar 448. Upon full insertion of insert 42 into interior 54, rim 465 resiliently returns to its initial shape (shown in FIG. 24B), to inhibit inadvertent withdrawal of insert 42 through side opening 460. In the example illustrated, rim 465 is sufficiently flexible to allow insert 42 to be manually pushed through side opening 460 while flexing rim 465, yet sufficiently rigid to inhibit insert 42 from accidentally falling through rim 465. In some implementations, the resilient flexible nature of rim 465 may be achieved by providing rim 465 with a reduced thickness to facilitate such flexing. In other implementations, rim 465 may be formed from a material different than the remaining material of body 53, wherein rim 465 is otherwise affixed to or over molded with respect to the remainder of body 53.

Side slot 462 has a width less than a corresponding with of flexible tether 38. In the example illustrated, side slot 462 is likewise bordered by resiliently flexible edges 467. Edges 467 are resiliently flexible so as to bend during manual insertion of flexible tether 38 through side slot 462 or doing withdrawal of flexible tether 38 through side slot 462. In some implementations, the resilient flexible nature of edges 467 may be achieved by providing edges 467 with a reduced thickness to facilitate such flexing. In other implementations, edges 467 may be formed from a material different than the remaining material of body 53, wherein edges 467 or otherwise affixed to or over molded with respect to the remainder of body 53. Edges 467 facilitate passage of flexible tether 38 into tether passage 58 of interior 54 while assisting in retaining flexible tether 38 within tether passage 58 once inserted.

Figure 25:
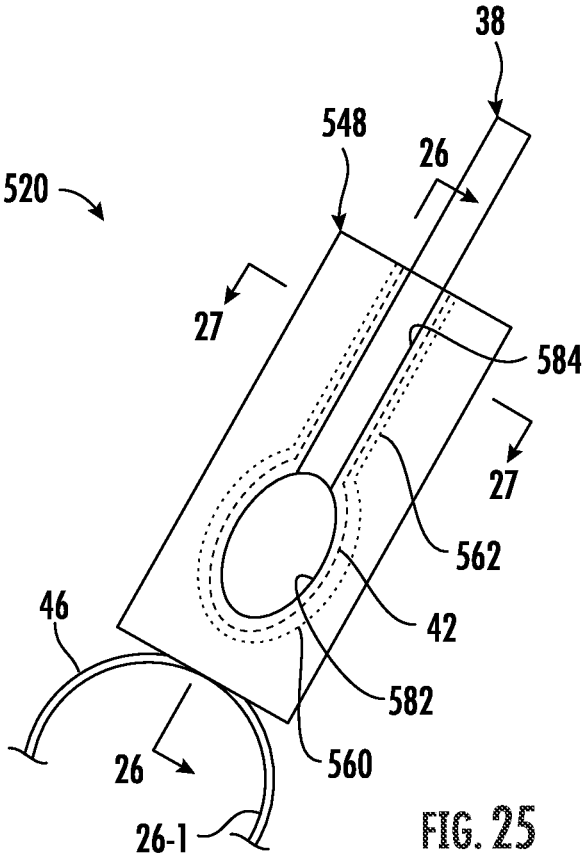
FIG. 25 is a diagram illustrating the example insert of FIG. 2 positioned within an example collar to removably or releasably connect the example removable wrist strap assembly to an example racquet.
Figure 26:
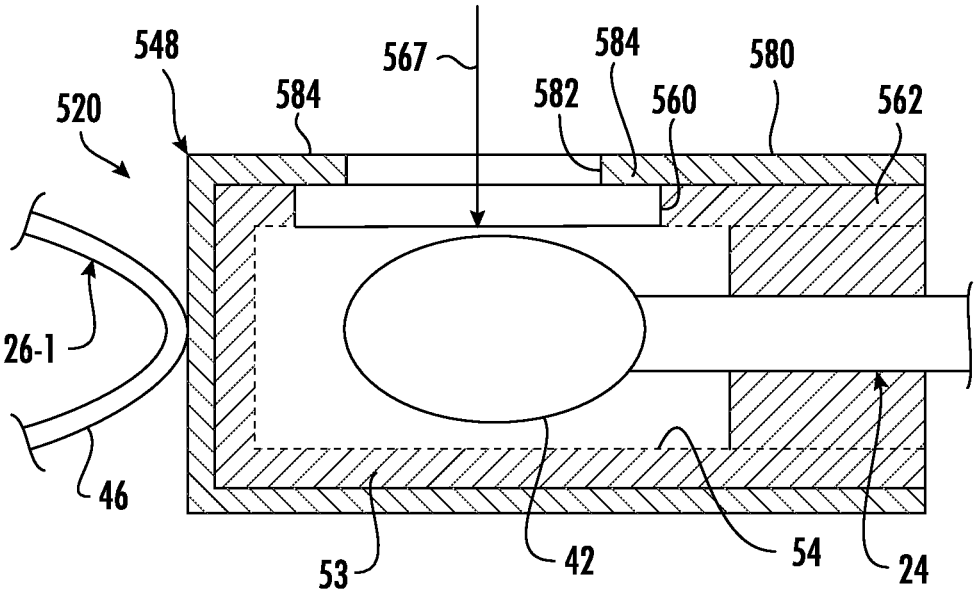
FIG. 26 is a sectional view through the example collar of FIG. taken along the line 26-26 following the initial insertion of the example insert of FIG. 2 into the example collar.
Figure 27:
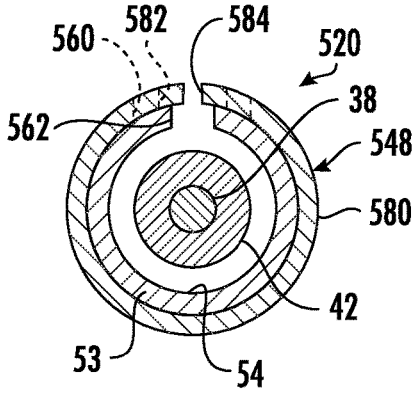
FIG. 27 is a sectional of the example collar in the example insert of FIG. 25 taken along line 27-27.

FIGS. 25-27 illustrate an example sports racquet and removable wrist strap system 520. FIG. 25 illustrates another example collar 548 for releasably retaining insert 42 and connecting racquet 24 (shown in FIG. 1) to a removable wrist strap assembly, such as assembly 26-1. Those components of system 520 which correspond to components of system 20 are numbered similarly and/or are shown in FIGS. 1-4.

Collar 558 is similar collar 448 described above except that collar 558 comprises side opening 560 and side slot 562. Side opening 560 and side slot 562 are each sufficiently large for the passage of insert 42 and flexible tether 38, respectively, in a sideways fashion into the interior 54 of collar 558. Each of side opening 460 and side slot 462 have inflexible rims or edges.

As shown by FIGS. 25 and 27, collar 558 additionally comprises an outer sleeve 580 which at least partially extends about body 53 and has a side opening 582 overlying or aligned with side opening 460 and a side slot 584 aligned with and overlying side slot 562, wherein side opening 582 and side slot 584 are dimensioned smaller than the corresponding dimensions of insert 42 and tether 38. In some implementations, outer sleeve 580 may be over molded about body 53. In other implementations, outer sleeve 580 may be slid onto or otherwise affixed to body 53.

Outer sleeve 582 comprises overhanging portions 584 that project over side opening 460 and which are sufficiently large and sufficiently flexible so as to bend to allow insert 42 to be inserted in a sideways fashion through side opening 582 as indicated by arrow 567. Likewise, flexible tether 38 may also be moved in a sideways fashion through side slot 584. As a result, insert 42 may be inserted into interior 54 in a sideways orientation, wherein axis 66 of insert 42 is parallel to axis 68 of collar 448. Upon full insertion of insert 42 into interior 54, overhanging portions 582 resiliently return to their initial shape to inhibit inadvertent withdrawal of insert 42 through side opening 582. In the example illustrated, overhanging portions 582 are sufficiently flexible to allow insert 42 to be manually pushed through side opening 582 while flexing overhanging portions 584, yet sufficiently rigid to inhibit insert 42 from accidentally falling through overhanging portions 584.

Figure 28:
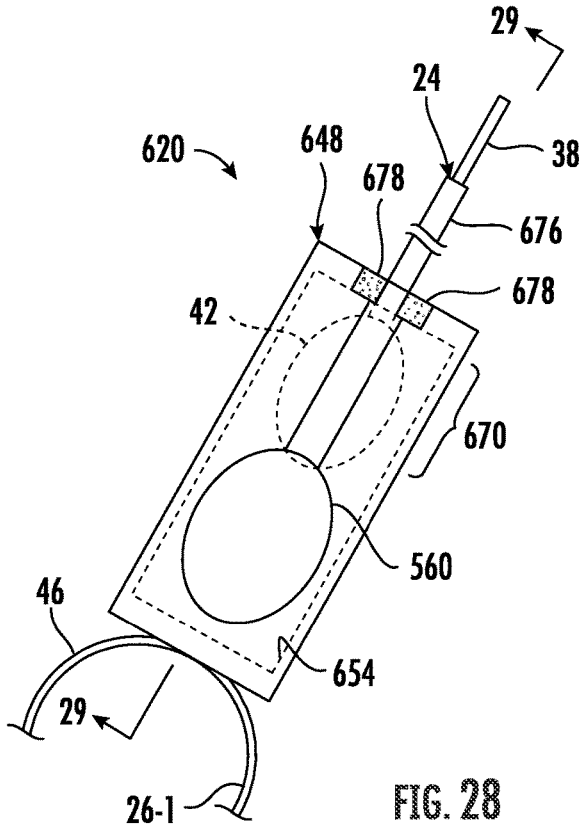
FIG. 28 is a diagram illustrating the example insert positioned within an example collar to removably or releasably connect the example removable wrist strap assembly to an example racquet.
Figure 29:
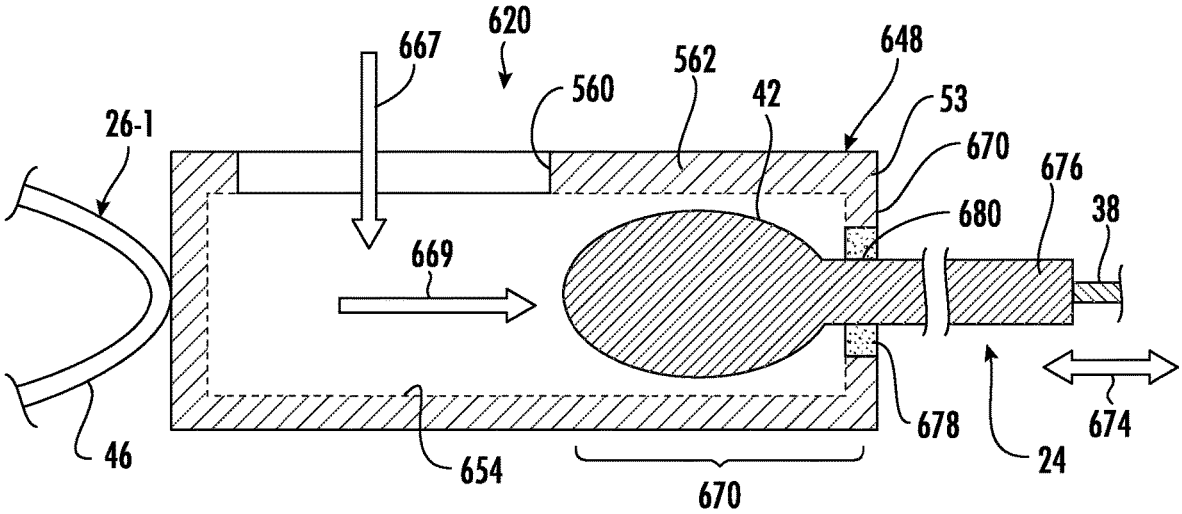
FIG. 29 is a sectional view of the example collar of FIG. 28 taken along line 29-29 illustrating insertion the example insert captured within the example collar.

FIG. 28-29 illustrate an example sports racquet and removable wrist strap system 620. FIGS. 28-29 illustrate another example collar 648 for releasably retaining insert 42 and connecting racquet 24 (shown in FIG. 1) to a removable wrist strap assembly, such as assembly 26-1. Those components of system 620 which correspond to components of system 20 are numbered similarly and/or are shown in FIGS. 1-4.

Collar 648 similar collar 548 described above except that collar 648 omits outer sleeve 580. In addition, collar 648 has an extended interior 654, having a length extending from side opening 560 to the axial end 670 which is sufficiently long for receiving at least a majority, and in some implementations, the entirety of the axial length of insert 42. As a result, insert 42 may be inserted through side opening 560 in the direction indicated by arrow 667. Thereafter, insert 42 may be pulled in the direction indicated by arrow 669 until insert 42 has been moved into an insert holding region 670 below side slot 562. Because forces experienced by system 620 are largely in the direction indicated by arrows 674, insert 42 is unlikely to accidentally move in both a direction opposite to arrow 69 and in a direction opposite to arrow 667.

In the example illustrated, system 620 additionally comprises an extension post 676 coupled between insert 42 and flexible tether 38. Extension post 676 has a lower degree of flexibility as compared to flexible tether 38. Extension post 676 assists in facilitating the withdrawal of insert 42 from the interior 654 of collar 648. In particular, extension post 676 may be manually grassed pushed in a direction opposite arrow 669 until insert 42 is aligned below side opening 560. Thereafter, insert 42 may be lifted through side opening 560 in a direction opposite to that of arrow 667. In some implementations, extension post 676 has a length equal to or greater than the extended length of interior 654 which forms insert holding region 670. This extended length facilitates manual gripping of post 676 to lift insert 42 through side opening 560 and to likewise move extension post 676 through side slot 562. In some implementations, extension post 676 may be omitted, wherein flexible tether 38 is directly connected to insert 42.

As shown by stippling, in some implementations, collar 648 may additionally comprise a resiliently flexible rubber-like lip 678 about the axial opening 680 through which extension post 676 (or tether 38) extends). Lip 678 assist in gripping post 676 to inhibit accidental sliding movement of post 676 and of insert 42 in a direction opposite arrow 669. Lip 678 assists in retaining insert 42 in the insert holding region 670, inhibiting insert 42 from accidentally sliding to the left so as to underlie side opening 560.

Figure 30:
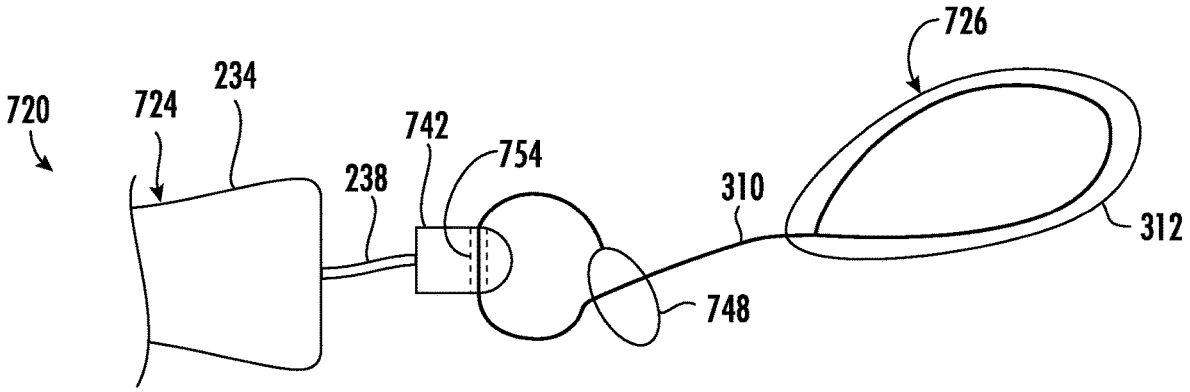
FIG. 30 is a perspective view illustrating an example sports racquet and removable wrist strap assembly system.

FIG. 30 is a diagram illustrating portions of an example sports racquet and removable wrist strap system 720. FIG. 30 illustrates an example of how a wrist strap may be releasably connected to a wrist strap connector that is tethered from an end of a racquet. System 720 comprises sports racquet 724 and wrist strap assembly 726. Sports racquet 724 comprises head 30 or 230, shown in FIGS. 1 and 10, respectively, handle 234 (described above with respect to FIGS. 10-12), flexible tether 238 (described above with respect to FIGS. 10-12) and a wrist strap connector 742 for releasably connecting to either of wrist strap assemblies 26. Flexible tether 238 has an effective length extending from an end of the handle 234 to the wrist strap connector 742, the effective length being at least 1 mm and no greater than 5 mm. The wrist strap connector 742 may be more easily manipulated for releasable connection to the wrist strap assembly 726. Because the effective length is no greater than 5 mm, the wrist strap connector 742 is less likely to bang or rattle about or constitute a nuisance to the player wearing the wrist strap assembly 726.

Wrist strap connector 742 comprise a member secured to the end of tether 238 and having a passage 754 (shown in broken lines) therethrough. Passage 754 is sufficiently dimensioned or sized such that portions of wrist strap assembly 726 may be threaded or passed through passage 754 to facilitate releasable securement of wrist strap assembly 726 to strap connector 742 and sports racquet 724.

Wrist strap assembly 726 is similar to wrist strap assembly 226 described above except that strap 310 has an end portion secured to or forming part of a flexible loop 748 rather than collar 248. Flexible loop 748 is sufficiently sized and compressible so as to be threadable through passage 754 of wrist strap connector 742. Flexible loop 748 is sufficiently sized such that strap 310 and padding 312 may be passed through loop 748. In some implementations, padding 312 may be omitted, wherein strap 310 itself forms a loop for receiving the hand and wrist of a person or player using system 720. As shown by FIG. 30, wrist strap assembly 726 is releasably connected to sports racquet 724 by passing loop 748 through passage 754 and subsequently passing strap 310 and padding 312 through loop 748. Removal or separation of wrist strap assembly 726 from sports racquet 724 may be achieved by passing strap 310 and padding 312 through loop 748 and then passing loop 748 through passage 754 of the strap connector 742.

Figure 31:
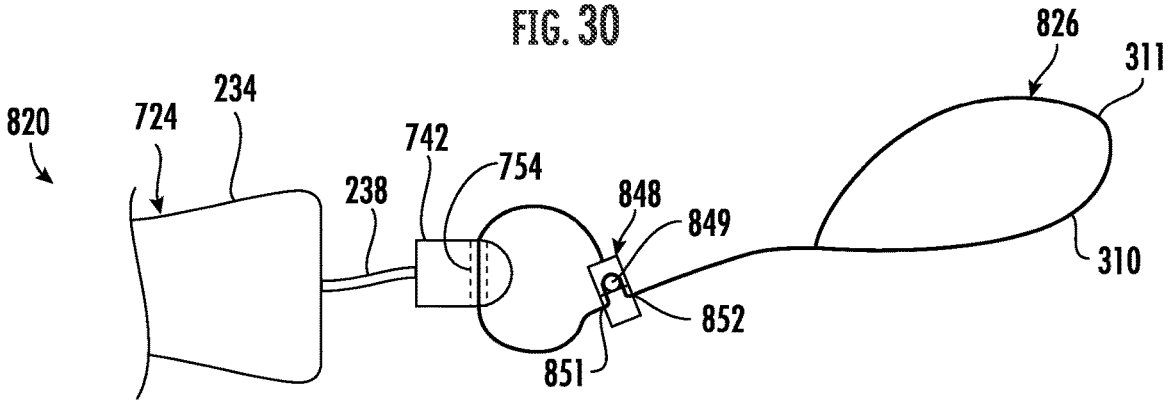
FIG. 31 is a perspective view illustrating an example sports racquet and removable wrist strap assembly system.

FIG. 31 is a diagram illustrating portions of an example sports racquet and removable wrist strap system 820. FIG. 30 illustrates an example of how a wrist strap may be releasably connected to a wrist strap connector that is tethered from an end of a racquet. FIG. 31 further illustrates an example of how the length of the wrist strap assembly may be adjustable to suit a player's preferences. System 820 comprises sports racquet 724 (described above) and wrist strap assembly 826.

Wrist strap assembly 826 is similar to wrist strap assembly 726 described above except that strap 310 omits padding 312 while forming a wrist receiving loop 311 and has an end portion secured to buckle 848 (portions of which are shown in section). Strap 310 and wrist receiving loop 311 are sufficiently thin or small and compressible so as to be capable of being threaded through passage buckle 848. As shown by FIG. 31, wrist strap assembly 826 is releasably connected to sports racquet 724 by passing loop 311 through passage 754 and subsequently passing strap 310 and loop 311 through buckle 848. Buckle 848 has a crossbar 849 in opposite openings 851, 852 which releasably grip strap 310 when strap 310 is under tension. Conversely, releasing such tension may buckle 848 to be repositioned along strap 310, facilitating securement of buckle 848 at various positions along the length of strap 310 to adjust the overall distance separating wrist receiving loop 311 from wrist strap connector 742. Removal or separation of wrist strap assembly 826 from sports racquet 724 may be achieved by passing strap 310 and loop 310 through buckle 848 and then passing loop 311 through passage 754 of the strap connector 742.

Figure 32:
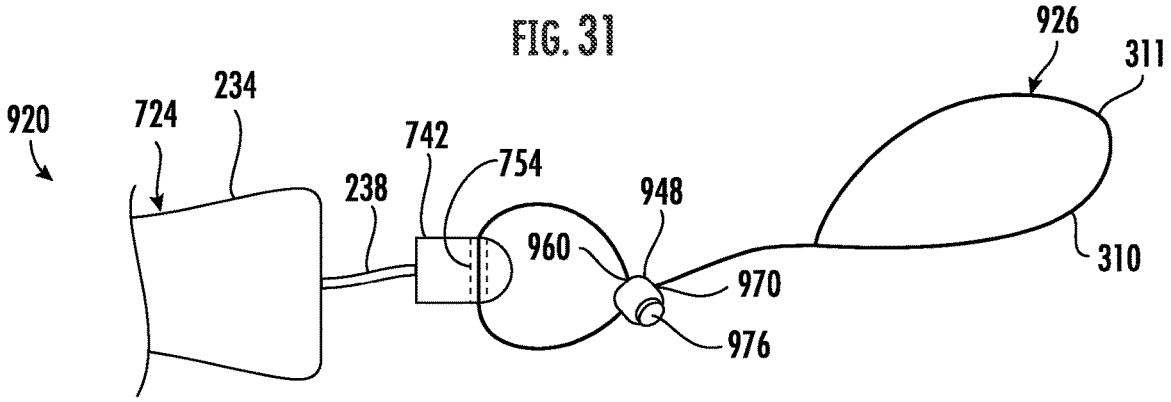
FIG. 32 is a perspective view illustrating an example sports racquet and removable wrist strap assembly system.

FIG. 32 is a diagram illustrating portions of an example sports racquet and removable wrist strap system 920. FIG. 32 illustrates an example of how a wrist strap may be releasably connected to a wrist strap connector that is tethered from an end of a racquet. FIG. 32 further illustrates an example of how the length of the wrist strap assembly may be adjustable to suit a player's preferences. System 920 comprises sports racquet 724 (described above) and wrist strap assembly 926.

Wrist strap assembly 926 is similar to wrist strap assembly 826 described above except that wrist strap assembly 926 comprises snap or lock connector 948 in place of buckle 848. Those remaining components of system 920 which correspond to components of system 820 are numbered similarly.

Figure 33A:
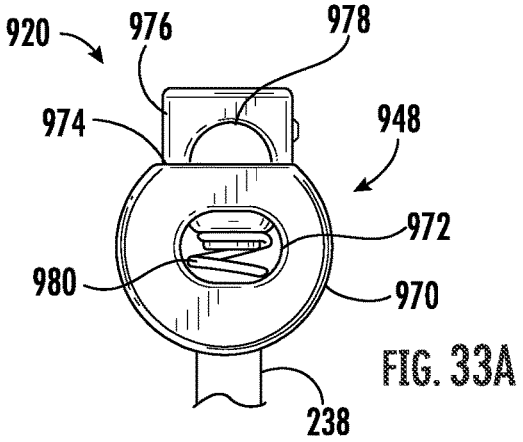
FIG. 33A is a perspective view illustrating an example connector of an example wrist strap assembly of the system of FIG. 32.
Figure 33B:
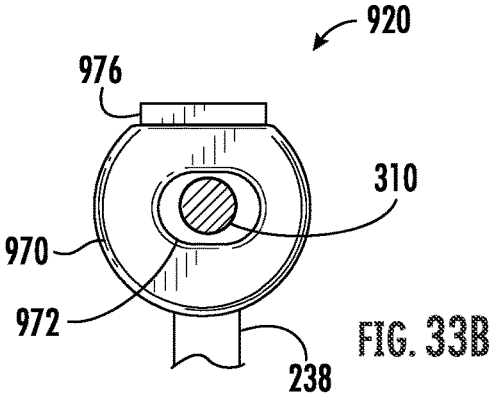
FIG. 33B is a perspective view illustrating the example connector of FIG. 33A receiving portions of the example wrist strap assembly.
Figure 33C:
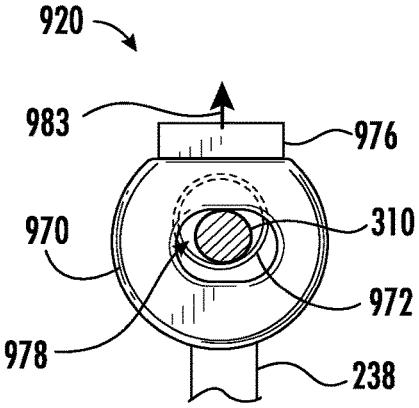
FIG. 33C is a perspective view illustrating the example connector of FIG. 33A gripping portions of the example wrist strap assembly.

Connector 948 is secured to an end 960 of cord or strap 310 while releasably gripping an intermediate portion of strap 310 which passes through connector 948. Connector 948 may grip strap 310 at any of a multitude of different locations along the length of strap 310, allowing the distance between the wrist receiving loop 311 and wrist strap connector 742 to be adjustable to suit the player's preferences. In the example illustrated, connector 948 comprises a single hole spring-loaded cord lock. FIGS. 33A, 33B and 33C illustrate connector 948. FIG. 33A illustrates connector 948 prior to the reception of cable 310. As shown by FIG. 33A, connector 948 comprises a main body 970 having a first opening 972 therethrough and a second opening 974 and through which piston 976 is slidably received. Piston 976 includes an opening 978 and is resiliently biased by a compression spring 980 captured between piston 976 and an interior of body 970.

FIG. 33B illustrates the depression of piston 976, against compression spring 980, to more fully align opening 978 with opening 972. While openings 978 and 972 are held this aligned state, wrist receiving loop 311 and strap 310 may be passed through opening 972 and through opening 978. FIG. 31B illustrates the release of piston 976. As a result, spring 980 resiliently urges piston 976 in the direction indicated by arrow 983 such that portions of piston 976 about opening 978 pinch strap 310 against portions of bodies 970 about opening 972, gripping strap 310 and reducing the likelihood of strap 310 being further pulled through connector 948. Manual depression of piston 976 allows strap 310 to be released, strap be slid or moved in either direction through openings 978 and 972. By selectively locating connector 948 along the length of strap 310, the spacing of wrist receiving loop 311 from wrist strap connector 742 and from handle 234 of sports racquet 724 may be adjusted to a player's preference.

To disconnect wrist strap assembly 926 from sports racquet 724, piston 976 may be manually depressed to align openings 972 and 978 such that loop 311 may be passed through such openings. Thereafter, loop 311 may be passed through passage 754 to disconnect wrist strap assembly 926 from sports racquet 724.

Figure 34:
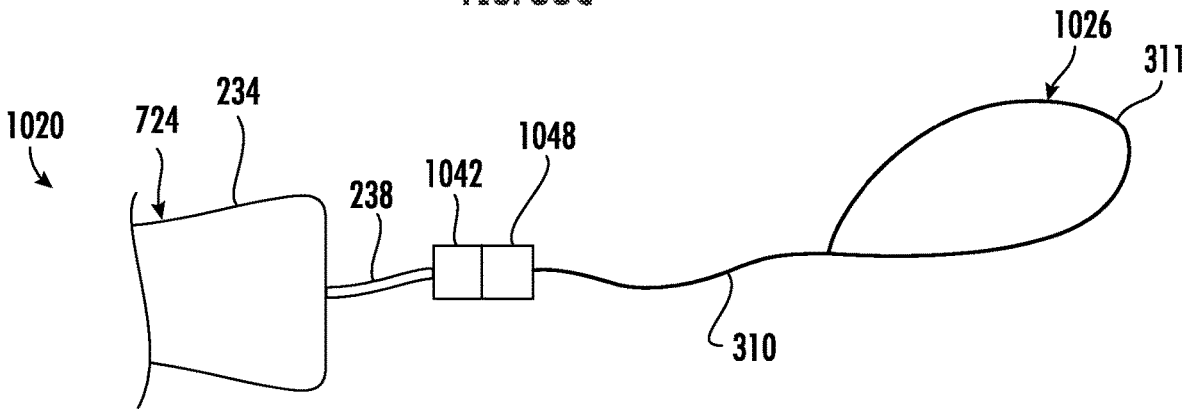
FIG. 34 is a perspective view illustrating an example sports racquet and removable wrist strap assembly system.

FIG. 34 is a diagram illustrating portions of an example sports racquet and removable wrist strap system 1020. FIG. 34 illustrates an example of how a wrist strap may be releasably connected to a wrist strap connector that is tethered from an end of a racquet. System 920 comprises sports racquet 1024 and wrist strap assembly 1026.

Sports racquet 724 comprises head 30 or 230, shown in FIGS. 1 and 10, respectively, handle 234 (described above with respect to FIGS. 10-12), flexible tether 238 (described above with respect to FIGS. 10-12) and a wrist strap connector 1042. Flexible tether 238 has an effective length extending from an end of the handle 234 to the wrist strap connector 1042, the effective length being at least 1 mm and no greater than 5 mm. Because the effective length is no greater than 5 mm, the wrist strap connector 1042 is less likely to bang or rattle about or constitute a nuisance to the player wearing the wrist strap assembly 1026.

Wrist strap connector 1042 comprise a first member or portion of a plastic quick side release connector, such as plastic side release buckle. Connector 1042 is secured to tether 238.

Wrist strap assembly 1026 is similar to wrist strap assembly 226 described above except that strap 310 has an end portion secured to a second member or second portion of a plastic quick side release connector 1048, such as a plastic side release buckle. Connectors 1042 and 1048, schematically shown, may comprise a "male" connector or buckle member, the hook end, and a "female" buckle or connector member, the insertion end. Pressing in on the sides of the connector buckle, pressing the two resilient plastic side prongs of the male connector, into the side openings of the female connector of the female connector member causes the side release connector or buckle to release, allowing the wrist strap assembly 1026 to be disconnected from and separated from sports racquet 724.

In some implementations connector 1048 may comprise a buckle that grips cord 310 and that allows cord 3102B slid through the buckle, adjusting a distance between loop 311 and connector 1042 and sports racquet 724. In some limitations, connectors 1042 comprises the male connector of the side release buckle or connector. In some implementations, connector 1042 comprises the female or insert portion of the side release buckle or connector.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A sports racquet and removable wrist strap system comprising:
- a head;
- a handle coupled to the head;
- a flexible tether extending from an end of the handle;
- a wrist strap; and
- a wrist strap connector releasably connecting the wrist strap to the flexible tether, the wrist strap connector comprising:
  - a collar connected to one of the wrist strap and the flexible tether, the collar having an interior having a side opening and a side slot extending from the side opening; and
  - an insert connected to the other of the wrist strap and the flexible tether,
- wherein the insert is insertable into the interior through the side opening while portions of the wrist strap or the flexible tether are insertable into the interior through the side slot.

2. The sports racquet and removable wrist strap system of claim 1, wherein the insert is non-spherically shaped so as to be insertable through the side opening while at a predefined orientation.

3. The sports racquet and removable wrist strap system of claim 1 wherein the collar extends along a longitudinal axis, wherein the side opening has a first maximum width transverse to the longitudinal axis and wherein the side slot has a second maximum width transverse to the longitudinal axis and less than the first maximum width.

4. The sports racquet and removable wrist strap system of claim 3, wherein the collar is connected to the wrist strap, wherein portions of the wrist strap adjacent the collar comprise a pair of side-by-side cords and wherein the second maximum width of the side slot is less than a combined width of the pair of side-by-side cords.

5. The sports racquet and removable wrist strap system of claim 1, wherein the collar is formed from a resiliently flexible polymer.

6. The sports racquet and removable wrist strap system of claim 1, wherein the handle comprises a cavity extending from the end of the handle towards the head and wherein the flexible tether is secured to the handle within the cavity.

7. The sports racquet and removable wrist strap system of claim 6, wherein the handle comprises an end cap covering the cavity and wherein the flexible tether extends through the end cap.

8. The sports racquet and removable wrist strap system of claim 1 wherein the insert is connected to the flexible tether and wherein the collar is connected to the wrist strap.

9. The sports racquet and removable wrist strap system of claim 1, wherein the side slot extends along a slot axis, wherein the insert has a first longitudinal dimension and a second transverse dimension less than the longitudinal dimension, wherein the side opening has a maximum dimension less than the first longitudinal dimension and greater than the second transverse dimension, and wherein the interior of the collar is sized to receive the insert through the side opening and to permit the insert to be pivoted within the interior from a first position in which a longitudinal axis of insert extends perpendicular to the slot axis to a second position in which the longitudinal axis of the insert extends parallel to the slot axis.

10. The sports racquet and removable wrist strap system of claim 1 wherein the flexible tether has an effective length no greater than 5 mm.

11. A removable wrist strap assembly for a sports racquet having a flexible tether extending from an end of a handle of the sports racquet, the flexible tether being connected to one of a collar and an insert, the removable wrist strap assembly comprising:

a wrist strap forming a loop to receive a person's hand and wrist; and the other of the collar and the insert connected to the loop, wherein the collar has an interior having a side opening and a side slot extending from the side opening and wherein the insert is insertable into the interior through the side opening while portions of the wrist strap or the flexible tether are insertable into the interior through the side slot.

12. The wrist strap assembly of claim 11, wherein the insert is non-spherically shaped so as to be insertable through the side opening while at a predefined orientation.

13. The wrist strap assembly of claim 11, wherein the collar extends along a longitudinal axis, wherein the side opening has a first maximum width transverse to the longitudinal axis and wherein the side slot has a second maximum width transverse to the longitudinal axis and less than the first maximum width.

14. The wrist strap assembly of claim 13, wherein the collar is connected to the wrist strap, wherein portions of the wrist strap adjacent the collar comprise a pair of side-by-side cords and wherein the second maximum width of the side slot is less than a combined with of the pair of side-by-side cords.

15. A sports racquet for use with a wrist strap connected to, the sports racquet comprising:

a head;

a handle coupled to the head;

a wrist strap connector; and a flexible tether having an effective length extending from an end of the handle to the wrist strap connector, the effective length being at least 1 mm and no greater than 5.0 mm, wherein the wrist strap comprises one of a collar and an insert and wherein the wrist strap connector comprises the other of the collar and the insert connected to the flexible tether, wherein the collar has an interior having a side opening and a side slot extending from the side opening and wherein the insert is insertable into the interior through the side opening while portions of the wrist strap or the flexible tether are insertable into the interior through the side slot.

16. The sports racquet of claim 15, wherein the handle comprises a cavity extending from the end of the handle towards the head and wherein the flexible tether is secured to the handle within the cavity.

17. The sports racquet of claim 15, wherein the handle comprises an end cap covering the cavity and wherein the flexible tether extends through the end cap.

18. The sports racquet of claim 15, wherein the insert is connected to the flexible tether and wherein the collar is connected to the wrist strap.

19. The sports racquet of claim 15, wherein the insert is non-spherically shaped so as to be insertable through the side opening while at a predefined orientation, wherein the collar extends along a longitudinal axis, wherein the side opening has a first maximum width transverse to the longitudinal axis and wherein the side slot has a second maximum width transverse to the longitudinal axis and less than the first maximum width.

* * * * *